US011028520B2

(12) United States Patent
Lee et al.

(10) Patent No.: US 11,028,520 B2
(45) Date of Patent: Jun. 8, 2021

(54) LAUNDRY TREATING APPARATUS

(71) Applicant: LG Electronics Inc., Seoul (KR)

(72) Inventors: Jihong Lee, Seoul (KR); Minkyu Sang, Seoul (KR)

(73) Assignee: LG Electronics Inc., Seoul (KR)

( * ) Notice: Subject to any disclaimer, the term of this patent is extended or adjusted under 35 U.S.C. 154(b) by 123 days.

(21) Appl. No.: 15/989,574

(22) Filed: May 25, 2018

(65) Prior Publication Data

US 2019/0024291 A1 Jan. 24, 2019

(30) Foreign Application Priority Data

Jul. 19, 2017 (KR) ..... 10-2017-0091636

(51) Int. Cl.

| | |
|---|---|
| ***D06F 39/02*** | (2006.01) |
| ***D06F 39/08*** | (2006.01) |
| *D06F 29/00* | (2006.01) |

(52) U.S. Cl.

CPC ..... *D06F 39/02* (2013.01); *D06F 39/088* (2013.01); *D06F 29/00* (2013.01)

(58) Field of Classification Search

None

See application file for complete search history.

(56) References Cited

U.S. PATENT DOCUMENTS

| | | | | |
|---|---|---|---|---|
| 7,293,436 | B2 * | 11/2007 | No | D06F 39/028 134/104.1 |
| 8,800,325 | B2 * | 8/2014 | Chung | D06F 39/081 68/17 R |
| 2004/0231370 | A1 * | 11/2004 | Cheo | D06F 37/28 68/3 R |

FOREIGN PATENT DOCUMENTS

| | | |
|---|---|---|
| EP | 2063014 | 5/2009 |
| EP | 2719816 | 4/2014 |
| KR | 200136097 | 5/1999 |
| KR | 1020110009918 | 1/2001 |
| KR | 1020020050033 | 12/2002 |
| KR | 1020040046969 | 6/2004 |
| KR | 1020080065762 | 7/2008 |
| KR | 1020130025674 | 3/2013 |
| KR | 1020150025083 | 3/2015 |
| KR | 1020170003396 | 1/2017 |

(Continued)

OTHER PUBLICATIONS

European Search Report in European Appln. No. 18176204.8, dated Nov. 29, 2018, 7 pages.

*Primary Examiner* — Michael E Barr
*Assistant Examiner* — Jason P Riggleman
(74) *Attorney, Agent, or Firm* — Fish & Richardson P.C.

(57) ABSTRACT

A laundry treating apparatus includes a housing, a tub, a drum, a top cover located above the housing and configured to cover an upper portion of the tub and the drum, a detergent box, a distributor configured to receive washing water from an external water supply source and to distribute washing water, a detergent water supply pipe connected to the distributor, and a tub water supply pipe connected to the distributor. The top cover includes a distributor holder located at a rear portion of the top cover and configured to support the distributor, a detergent box holder located at a front portion of the top cover and configured to support the detergent box, and a first pass through that allows the detergent water supply pipe to pass through the top cover from an upper portion of the top cover to a lower portion of the top cover.

22 Claims, 17 Drawing Sheets

(56) References Cited

FOREIGN PATENT DOCUMENTS

| | | |
|---|---|---|
| WO | WO2008084933 | 7/2008 |
| WO | WO2008120930 | 10/2008 |

* cited by examiner

LAUNDRY TREATING APPARATUS

CROSS-REFERENCE TO RELATED APPLICATIONS

This application claims the benefit of the Korean Patent Application No. 10-2017-0091636, filed on Jul. 19, 2017, which is hereby incorporated by reference as if fully set forth herein.

BACKGROUND OF THE INVENTION

Field of the Invention

The present invention relates to a laundry treating apparatus.

Discussion of the Related Art

Generally, a laundry treating apparatus includes an apparatus for washing laundry (laundry for washing or laundry for drying), an apparatus for drying laundry, and an apparatus for performing both washing and drying laundry.

The laundry treating apparatus of the related art, which can wash laundry, includes a tub in which water is stored, a drum rotatably provided inside the tub to store laundry therein, and a detergent supply unit for supplying a detergent to the tub.

The laundry treating apparatus of the related art is generally provided such that one tub and one drum are provided in one cabinet. That is, it is general that one laundry treating apparatus includes one laundry treating portion having a tub and a drum.

However, products in which one laundry treating apparatus includes two laundry treating portions have been recently provided in accordance with the need of separate washing and simultaneous washing.

As an example of a washing machine, an auxiliary washing machine may be provided on a main washing machine, or vice versa. That is, two washing machines may be provided on or below one cabinet, whereby a user may perform separate washing and simultaneous washing through one washing machine. This machine may be referred to as a twin washing machine or a twin laundry treating apparatus.

For this reason, the auxiliary washing machine has no option but to be smaller than the general washing machine of the related art. Therefore, since a space of the auxiliary washing machine is relatively small, it is not easy to manufacture the auxiliary washing machine. This is because that various components provided in a large scaled washing machine are also required for the auxiliary washing machine of a small size. There is a difficulty in arranging and assembling the various components in a limited space.

In this respect, it is required to provide a small-scaled laundry treating apparatus or twin laundry treating apparatus, of which manufacture is easy and usage is convenient.

SUMMARY OF THE INVENTION

Accordingly, the present invention is directed to a laundry treating apparatus that substantially obviates one or more problems due to limitations and disadvantages of the related art.

An object of the present invention is to provide a laundry treating apparatus that may be manufactured easily and used conveniently.

Another object of the present invention is to provide a laundry treating apparatus that may be manufactured easily by improving a structure of a top cover for covering upper portions of a tub and a drum.

Still another object of the present invention is to provide a laundry treating apparatus that may be manufactured easily by providing a detergent box and a detergent water supply pipe for supplying washing water to the detergent box in a top cover before the top cover covers upper portions of a tub and a drum.

Further still another object of the present invention is to provide a laundry treating apparatus that may be manufactured easily by forming a housing having front and rear sidewalls and left and right sidewalls to receive a tub and a drum therein, and has a simple configuration.

Further still another object of the present invention is to provide a laundry treating apparatus that may be manufactured by connecting the outside of a housing with inner components of the housing.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating apparatus according to one embodiment of the present invention comprises a housing; a tub provided inside the housing, for storing washing water therein; a drum rotatably provided inside the tub, for storing laundry therein; a top cover provided above the housing to cover upper portions of the tub and the drum; a detergent box communicated with the tub and provided to put a detergent therein; a distributor for distributing washing water supplied from an external water supply source; a detergent water supply pipe connected with the distributor, supplying washing water to the detergent box; and a tub water supply pipe connected with the distributor, supplying washing water to the tub, wherein the top cover includes a distributor holder formed at the rear of the top cover to allow the distributor to be held therein; a detergent box holder formed at the front of the top cover to allow the detergent box to be held therein; and a detergent water supply pipe pass through portion formed to pass through the detergent water supply pipe from an upper portion of the top cover to a lower portion of the top cover.

Preferably, a detergent water supply pipe holder to which the detergent water supply pipe is fixed is formed on a lower surface of the top cover. Therefore, the detergent water supply pipe is fixed to the top cover, whereby one top cover module or assembly may be regarded.

Preferably, the detergent water supply pipe holder includes a plurality of hose hangers for fixing the detergent water supply pipe.

Preferably, the top cover includes a tub water supply pipe pass through portion formed to pass through the tub water supply pipe from the upper portion of the top cover to the lower portion of the top cover.

Preferably, the detergent water supply pipe pass through portion and the tub water supply pipe pass through portion are formed at the rear of the top cover. Therefore, the tub water supply pipe and the detergent water supply pipe are extended from the rear of the top cover to the lower portion of the top cover, these components are not visible to a user.

Preferably, the top cover includes an opening provided to approach from the upper portion to the lower portion and then the inside of the drum, the distributor holder, the detergent water supply pipe pass through portion and the tub water supply pipe pass through portion are formed at the rear of the opening, and the detergent box holder is formed at the front of the opening.

Preferably, the detergent box holder includes a holder opening, and a step difference portion formed to be recessed from the periphery of the detergent inlet to the lower portion of the top cover. The holder opening is an opening formed in the top cover, and the detergent may be put into the detergent box fixed to the lower portion of the top cover through the holder opening.

The detergent box holder may include a housing holder formed on the lower surface of the top cover, to which a housing of the detergent box is fixed. This holder may be formed in various forms such as a fitting boss, hook or coupling rib. That is, the detergent box may rigidly be fixed at the lower portion of the top cover. Therefore, to detach the detergent box from the top cover, the top cover should be detached from the drawer body.

The step difference portion includes a mounting rib on which a detergent cover of the detergent box is mounted, and an inlet rib downwardly extended from the mounting rib, forming the detergent inlet.

Preferably, the detergent box holder includes a mounting rib spaced apart from the inlet rib, formed on the lower surface of the top cover to surround the inlet rib and provided to be tightly adhered to an inner circumference of the housing to the detergent box.

Preferably, a lower end of the inlet rib is arranged to be lower than that of the mounting rib.

The detergent box holder may include a detergent box housing holder formed at the outside of the mounting rib and on the lower surface of the top cover. These holders may include various types of holders such as fitting boss, fitting hole and hook.

The top cover may include a rear rib formed on a rear surface of the top cover, extended from a left and right side to an upper portion of the distributor holder and provided to prevent washing water from entering the rear.

The top cover may include a front rib formed on a front surface of the top cover, extended from the front of the detergent box holder to an upper portion of the detergent box holder and provided to prevent a detergent from entering the front.

The top cover may include a mounting rib horizontally extended from the front of the front rib and mounted in the housing at the upper portion of the housing.

The mounting rib may be provided with a cutting portion formed to expose the inside of the housing through the top cover after the top cover is mounted on the housing. In more detail, the cutting portion may be formed between the mounting ribs in a state that the mounting ribs are partially cut.

The mounting rib may be provided with a vertical coupling portion to which a control panel is coupled upwardly, and the front rib may be provided with a horizontal coupling portion to which the control panel is coupled at the front. Therefore, the control panel may stably be coupled to the rib.

The top cover may include a coupling rib downwardly extended from both sides of the top cover and coupled to the housing while covering both upper portions of the housing.

The detergent box holder may include a main detergent box holder formed at a left side or right side of the top cover, to which a main detergent box is fixed, and a side detergent box holder formed at an opposite side of the main detergent box holder, to which a side detergent box is fixed, and the detergent water supply pipe may include a main detergent water supply pipe for suppling washing water to the main detergent box and a side detergent water supply pipe for supplying washing water to the side detergent box.

In another aspect of the present invention, a laundry treating apparatus according to one embodiment of the present invention comprises a housing; a tub provided inside the housing, for storing washing water therein; a drum rotatably provided inside the tub, for storing laundry therein; a top cover provided above the housing to cover upper portions of the tub and the drum; a detergent box communicated with the tub and provided to put a detergent therein; a connection pipe for connecting the tub with the detergent box; a distributor for distributing washing water supplied from an external water supply source; a detergent water supply pipe connected with the distributor, supplying washing water to the detergent box; and a tub water supply pipe connected with the distributor, supplying washing water to the tub, wherein the top cover includes a distributor holder formed at the rear of the top cover to allow the distributor to be held therein; a detergent box holder formed at the front of the top cover to allow the detergent box to be held therein; a detergent water supply pipe pass through portion formed to pass through the detergent water supply pipe from an upper portion of the top cover to a lower portion of the top cover; and a cutting portion formed to expose the connection pipe arranged inside the housing and the detergent box to the outside of the housing and the top cover by forming a spaced interval with the housing.

In accordance with the cutting portion, the connection pipe arranged inside the housing is easily connected to the tub and the detergent box through the outside of the housing. Therefore, the laundry treating apparatus of which manufacture and configuration are simple may be provided.

According to one embodiment of the present invention, a laundry treating apparatus may be provided, which may be manufactured easily by improving a structure of a top cover for covering upper portions of a tub and a drum.

According to one embodiment of the present invention, a laundry treating apparatus may be provided, which may be manufactured easily by providing a detergent box and a detergent water supply pipe for supplying washing water to the detergent box in a top cover before the top cover covers upper portions of a tub and a drum.

According to one embodiment of the present invention, a laundry treating apparatus may be provided, which may effectively prevent water or detergent, which may flow from an upper portion of a top cover, from entering control components.

According to one embodiment of the present invention, a laundry treating apparatus having a relatively small capacity in a twin laundry treating apparatus may be provided, which may be manufactured easily.

According to one embodiment of the present invention, a laundry treating apparatus may be provided, which may be manufactured easily and has a simple configuration by forming a housing having front and rear sidewalls and left and right sidewalls in a single body to receive a tub and a drum therein and directly installing a drawer panel in the housing.

According to one embodiment of the present invention, a laundry treating apparatus may be provided, which enables rigid coupling and easy assembly between a drawer panel or a control panel and a housing through a coupling structure between the drawer panel or the control panel and the housing and a shape and may effectively prevent impurities from entering the housing.

According to one embodiment of the present invention, a laundry treating apparatus may be provided, which may implement a simple configuration and a volume of a drawer panel through a housing by omitting components interposed between the drawer panel and the housing.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Meanwhile, elements or control method of apparatuses which will be described below are only intended to describe the embodiments of the present invention and are not intended to restrict the scope of the present invention. Wherever possible, the same reference numbers will be used throughout the drawings to refer to the same or like parts.

Figure 1:
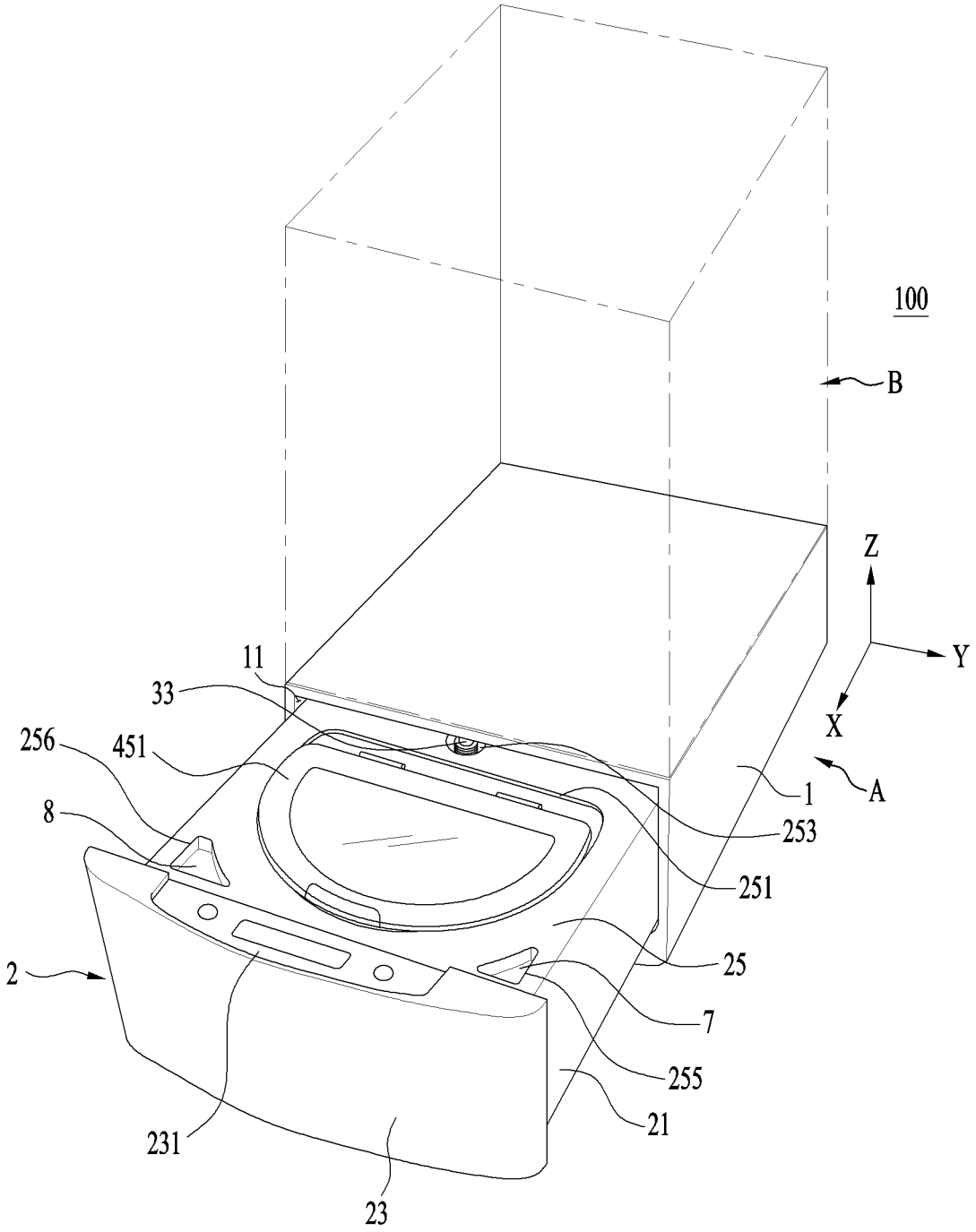
FIG. 1 illustrates an example of a laundry treating apparatus according to the present invention.
Figure 17:
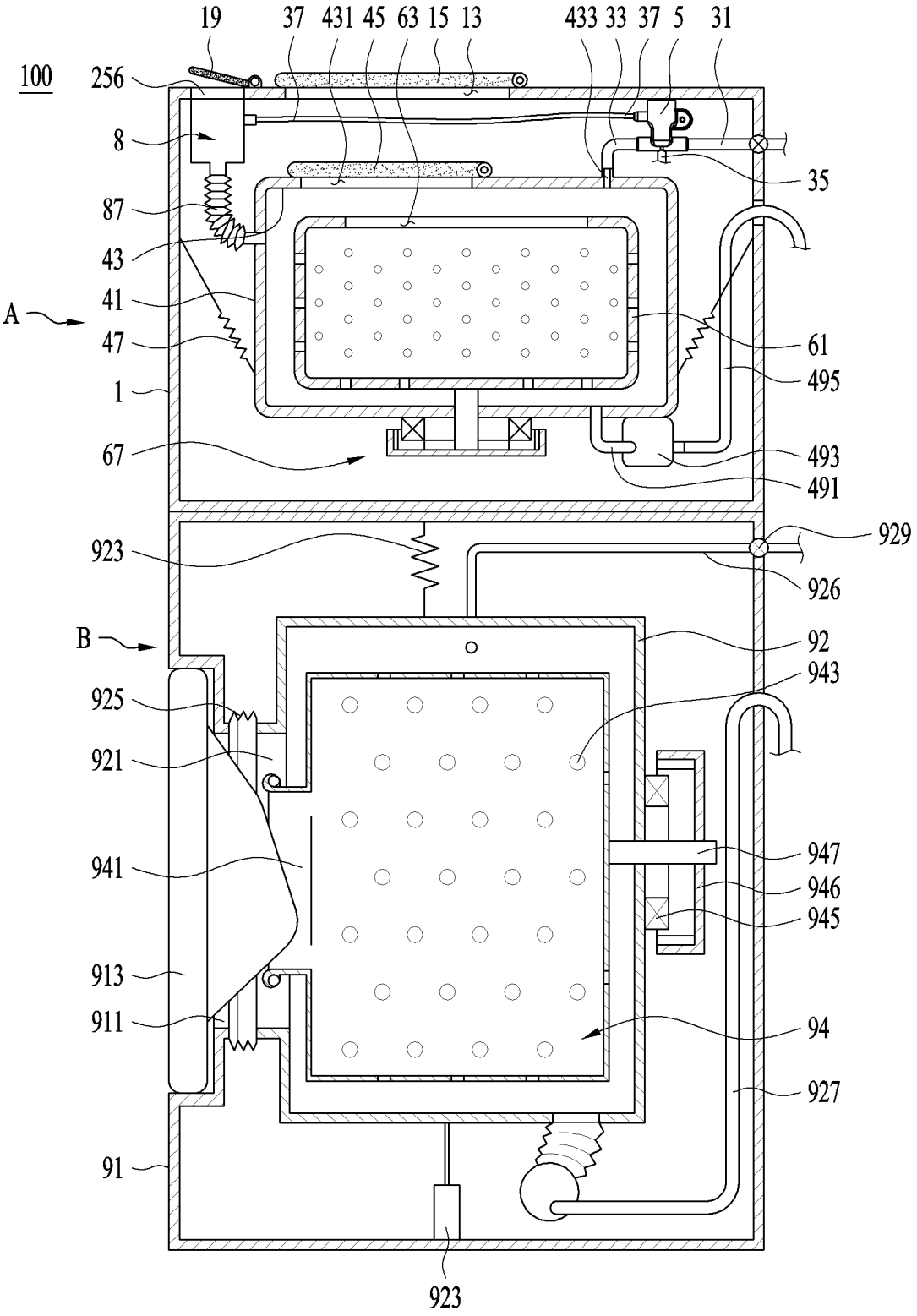
FIG. 17 illustrates another example of a laundry treating apparatus according to the present invention.

As shown in FIG. 1, a laundry treating apparatus 100 according to the present invention may include a first treating apparatus A for washing laundry, and a second treating apparatus B arranged on the first treating apparatus to wash or dry laundry. As shown in FIG. 17, the laundry treating apparatus may include a first treating apparatus A for washing laundry, and a second treating apparatus B provided to support a lower surface of the first treating apparatus.

Figure 2:
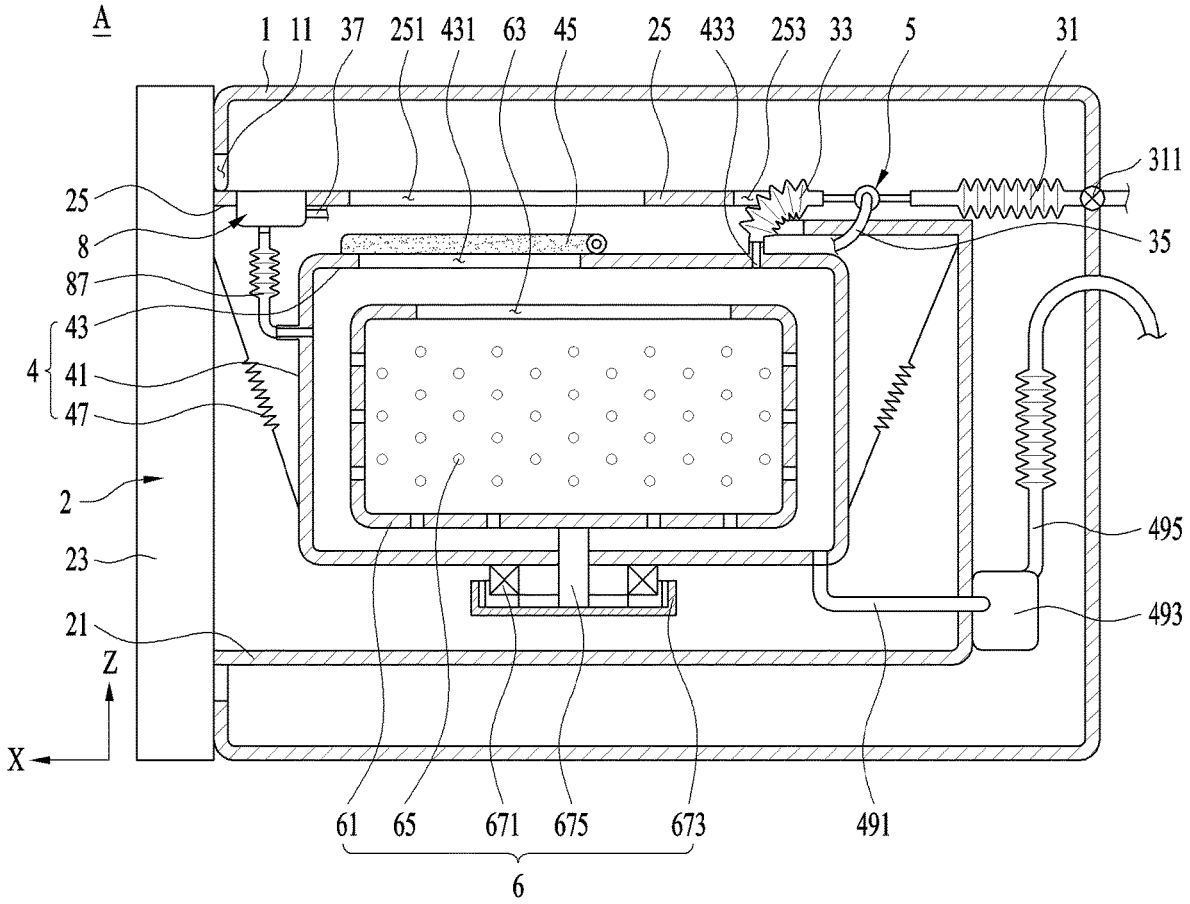
FIG. 2 illustrates an example of a first treating apparatus provided in a laundry treating apparatus according to one embodiment of the present invention.

As shown in FIG. 2, the first treating apparatus A may include a cabinet 1, a drawer 2 that may be ejected from the cabinet, a tub 4 provided inside the drawer, for storing water therein, and a drum 6 rotatably provided inside the tub, for storing laundry therein.

The cabinet 1 may be provided as a means for forming an external appearance of the first treating apparatus A, or may be provided as a space (space formed at a wall, etc.) for simply receiving the drawer 2. Also, the cabinet 1 may be provided as a means for forming an external appearance of the second treating apparatus B as well as the first treating apparatus A. Therefore, the cabinet 1 may form an external appearance of the laundry treating apparatus.

It is preferable that an outlet 11 to which the drawer 2 may be inserted is provided on a front surface of the cabinet 1.

The cabinet 1 may be provided to have a width direction (Y-axis direction) of which length is longer than a length of a height direction (Z-axis direction) (A width length of the drawer may be provided to be longer than a length of a height direction).

The drawer 2 may include a drawer body 21 inserted into the cabinet 1 through the outlet 11, a drawer panel 23 fixed to a front surface of the drawer body 21, opening or closing the outlet 11, and a top cover 25 for forming an upper surface of the drawer body 21.

If the drawer body 21 is inserted into the cabinet 1, the drawer panel 23 will close the outlet 11, and if the drawer body 21 is ejected from the cabinet 1, the drawer panel 23 will open the outlet 11.

The drawer panel 23 may include a control panel 231 (see FIG. 1) for inputting a control command related to an operation of the laundry treating apparatus 100 and displaying a message related to the operation of the laundry treating apparatus to a user.

The drawer body 21 may be inserted to the cabinet 1 through the inlet 11, and may be provided in all shapes that may provide a space for receiving the tub 4. FIG. 2 illustrates an example of a hexahedral shaped hollow drawer body 21.

The top cover 25 may include an opening 251 that communicates the inside of the drawer body 21 with the outside thereof. Since the drum in which washing is performed is provided inside the drawer body 21, an opening 251 may be provided to allow washing water between the inside of the drawer body 21 and the outside of the drawer body 21. Also, since the tub in which washing water is stored is provided in the drawer body 21, an opening 253 may be provided to supply washing water from the outside of the drawer body 21 to the inside of the drawer body 21. These openings may be referred to as a first cover opening 251 and a second cover opening 253.

The tub 4 includes a tub body 41 arranged inside the drawer body 21, in which water is stored, and a tub cover 43 forming an upper surface of the tub body 41. The tub body 41 may be provided in a hollow cylindrical shape. The tub cover 43 may include a tub inlet 431 for communicating the inside of the tub body 41 with the outside of the tub body 41, and a water supply pipe connector 433 for flowing water into the tub body 41.

The tub inlet 431 may be provided below the first cover opening 251 provided in the top cover, and the water supply pipe connector 433 may be provided below the second cover opening 253.

The tub inlet 431 is a means for inserting laundry into the tub body 41 or ejecting the laundry inside the tub body 41 to the outside of the tub body, and may be opened or closed by a door 45 rotatably coupled to the tub cover 43.

The tub 4 having the aforementioned structure may be fixed to the drawer body 21 through a tub support unit 47. The tub support unit 47 may be provided as a means for attenuating vibration generated in the tub body 41.

The drum 6 provided inside the tub 4 may include a cylindrical shaped drum body 61 provided with a drum inlet 63 provided on an upper surface. Since the drum inlet 63 is arranged below the tub inlet 431, laundry supplied from the outside of the tub through the tub inlet 431 may be supplied to the drum body 61 through the drum inlet 63.

A plurality of drum through holes 65 for communicating the inside of the drum body 61 with the tub body 41 may be provided on a bottom and a circumferential surface of the drum body 61.

The drum body 61 is rotated inside the tub body 41 by a driving unit 67. The driving unit 67 may include a stator 671 fixed to a bottom of the tub body and arranged outside the tub body 41, a rotor 673 rotated by a rotating field provided by the stator, and a rotary shaft 675 provided to pass through the bottom of the tub body 41, connecting the bottom of the drum body with the rotor.

In this case, the rotary shaft 675 may be provided to be orthogonal to the bottom of the tub body 41, and the drum inlet 63 may be provided to be parallel with the ground. The expression that the rotary shaft 675 is to be orthogonal to the bottom of the tub body 41 means that an angle between the rotary shaft and the bottom of the tub body is 90° within an error range (tolerance required during design or assembly).

The first treating apparatus A having the aforementioned structure discharges the water stored in the tub 4 to the outside of the cabinet 1 through a drainage unit. The drainage unit may include a drainage pump 493 fixed to the drawer body 21, a first tub drainage pipe 491 for guiding the water inside the tub body 41 to the drainage pump 493, and a second tub drainage pipe 495 for guiding the water discharged from the drainage pump 493 to the outside of the cabinet 1. In this case, the second tub drainage pipe 495 may be provided as a corrugated pipe (pipe made of a flexible material along a longitudinal direction or a pipe of a structure flexible in a longitudinal direction).

Figure 3:
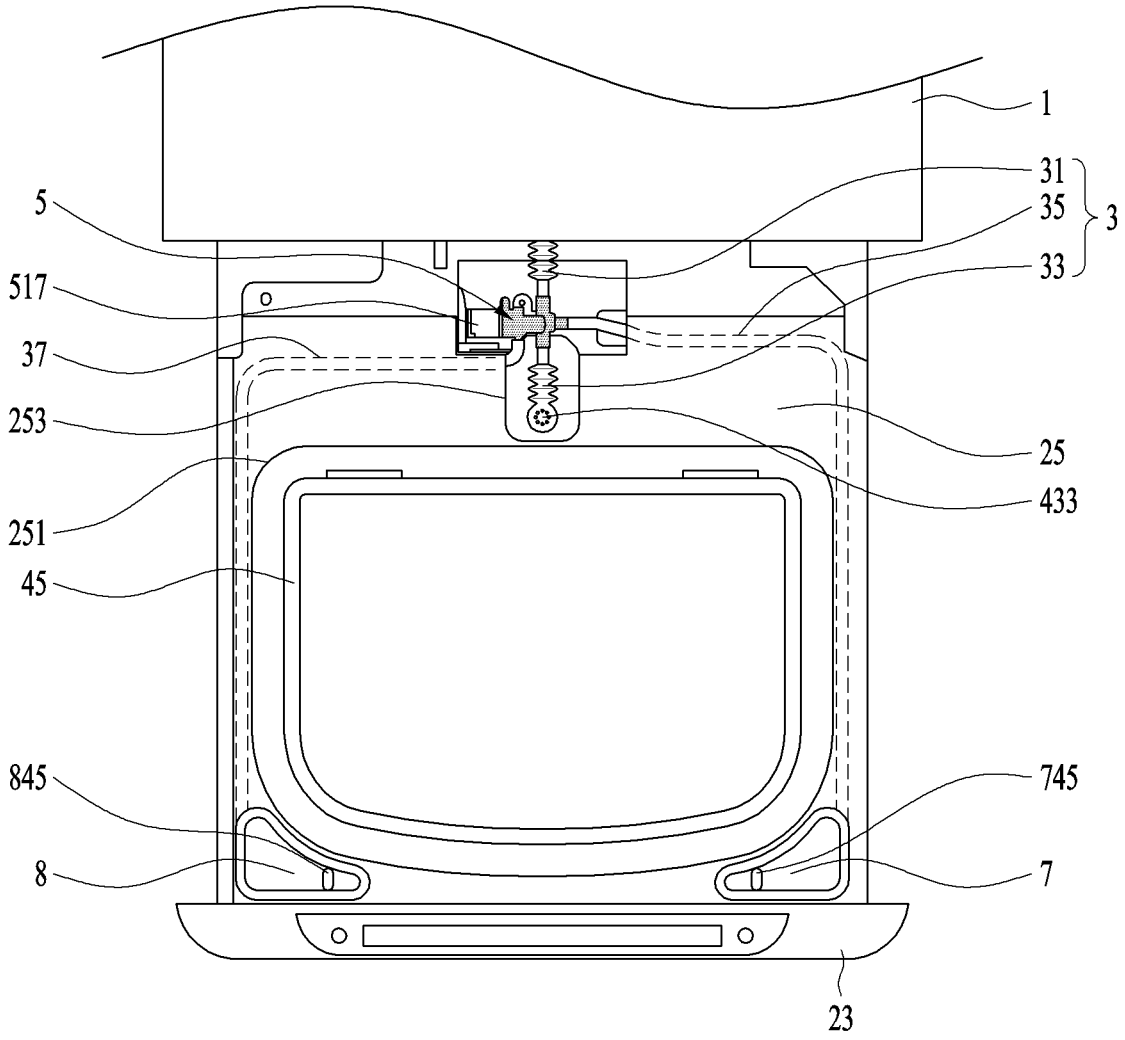
FIGS. 3 and 4 illustrate examples of a water supply unit and a distributor provided in a laundry treating apparatus according to one embodiment of the present invention.

The first treating apparatus A further includes a detergent supply means for supplying a detergent to the tub body 41. The detergent supply means for supplying a detergent to the first treating apparatus may include a detergent supply unit 7 only, or may include the detergent supply unit 7 (the first detergent supply unit) and a second detergent supply unit 8. FIG. 3 illustrates that the detergent supply means includes the first detergent supply unit 7 and the second detergent supply unit 8 as an example. The former unit may be referred to as a main detergent supply unit, and the latter unit may be referred to as a sub detergent supply unit.

If the detergent supply means includes the first detergent supply unit 7 and the second detergent supply unit 8, the water supply unit 3 provided in the first treating apparatus A may include a first water supply pipe 31 connected to a water supply source, a second water supply pipe 33 for guiding water to the tub body 41, a detergent water supply pipe 35 (the first detergent water supply pipe) for guiding water to the detergent supply unit 7 (the first detergent supply unit), and a second detergent water supply pipe 37 for guiding water to the second detergent supply unit 8. However, unlike the shown drawing, if the detergent supply means includes the first detergent supply unit 7 only, the water supply unit 3 may include the first water supply pipe 31, the second water supply pipe 33 and the detergent water supply pipe 35. Also, the first water supply pipe may be referred to as a main water supply pipe, and since the second water supply pipe 33 is configured to directly supply washing water to the tub, the second water supply pipe 33 may be referred to as a tub water supply pipe.

The first water supply pipe 31, the tub water supply pipe 33, the first detergent water supply pipe 35 and the second detergent water supply pipe 37 may be connected with one another through a distributor 5. The distributor 5 may distribute water entering therein through the first water supply pipe 31 into the tub water supply pipe 33, the first detergent water supply pipe 35 and the second detergent water supply pipe 37. That is, the washing water entering the distributor through the first water supply pipe may directly be supplied to the tub, or may be supplied to the tub through a detergent box.

The first water supply pipe 31 may be provided in a corrugated pipe type. The first water supply pipe 31 is provided to be opened or closed by a first valve 311 (see FIG. 2) provided to be driven under the control of a controller. Therefore, if the first valve 311 opens the first water supply pie 31, the water supplied from the water supply source may enter the distributor 5.

The water entering the distributor 5 will be supplied to the tub body 41 through the second water supply pipe 33.

One end of the first detergent supply pipe 35 is connected to the distributor 5, and the other end of the first detergent supply pipe 35 is connected to the first detergent supply unit 7. One end of the second detergent supply pipe 37 is connected to the distributor 5, and the other end of the second detergent supply pipe 37 is connected to the second detergent supply unit 8.

The first detergent supply unit 7 may be an element for supplying a detergent for washing into the tub. The first detergent supply unit 7 may be provided to supply a powder detergent or a liquid detergent, and may be provided to supply the detergent into the tub together with washing water during washing.

Therefore, if the washing water is supplied into the tub, the washing water may be supplied to the first detergent supply unit 7 and the tub water supply pipe at the same time.

On the other hand, the second detergent supply unit 8 may be provided to supply a specific additive into the tub at a specific time only. For example, the second detergent supply unit 8 may be provided to supply a softener or a bleach into the tub. The softener may be used during rinsing only, and the bleach may be supplied into the tub during a first rinsing or a last stage of a washing stroke.

Therefore, the time when the washing water is supplied into the tub through the second detergent supply unit 8 may be different from the time when the washing water is supplied into the tub through the first detergent supply unit 7 or the second water supply pipe 33.

Since a plurality of paths are connected through one distributor 5, a valve is required to selectively open the plurality of paths. To this end, a second valve 517 may be provided.

A path through which the washing water is supplied may be changed by the second valve 517 driven under the control of the controller.

Figure 4:
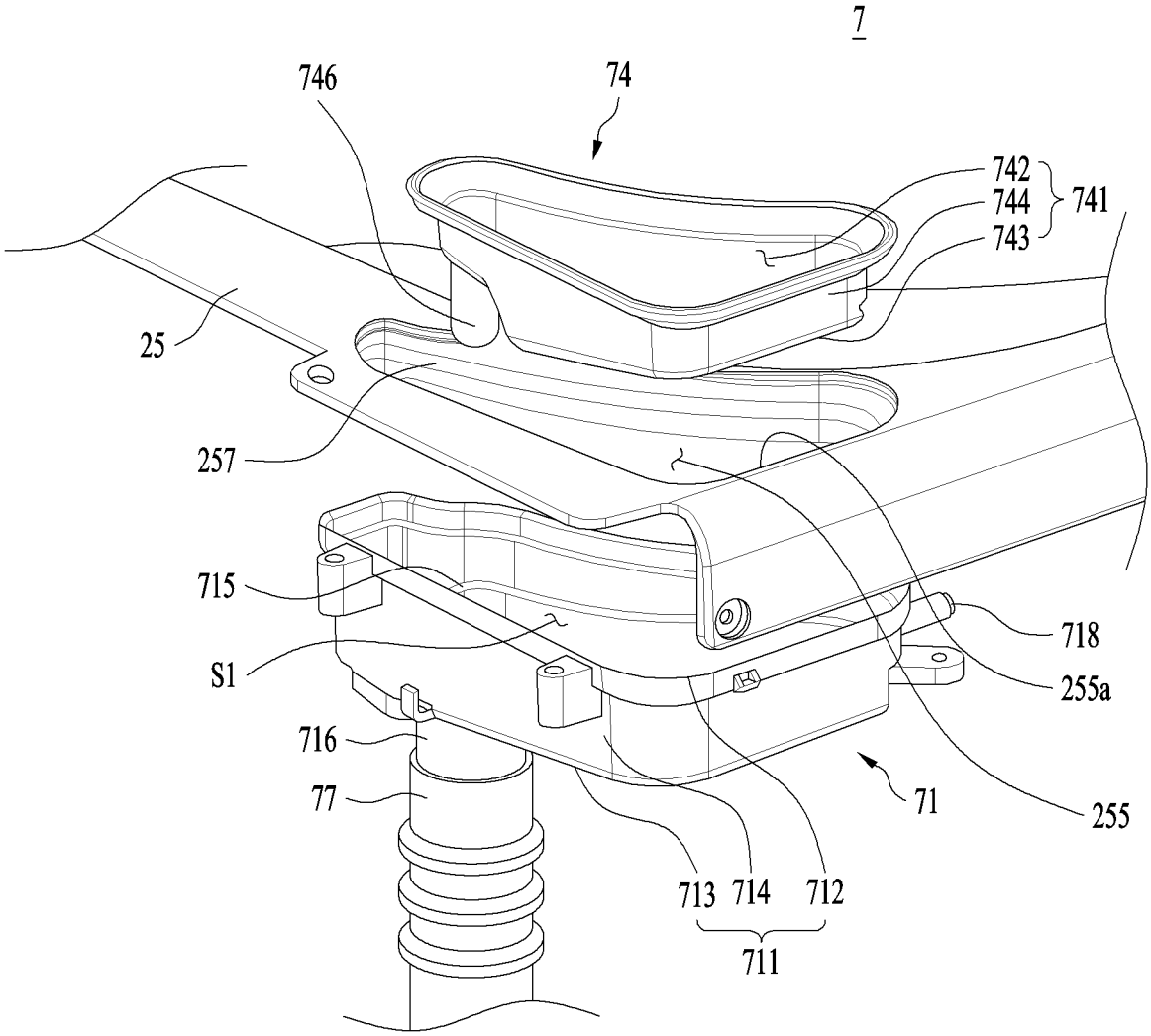

As shown in FIG. 4, the first detergent supply unit 7 (detergent supply unit) may be provided in the top cover 25 through a detergent box holder 255 (the first detergent box holder) provided to pass through the top cover 25. The detergent boxy holder 255 may include a holder opening 255*a*. A detergent box cover, which will be described later, may be inserted into the holder opening 255*a*. That is, the detergent box cover 74 may be inserted into the detergent box holder 255 through the holder opening 255*a*. On the contrary, the detergent box cover 74 may be taken out of the detergent box holder 255 through the holder opening 255*a*.

That is, the first detergent supply unit 7 may include a detergent box 71 (the first detergent box or main detergent box) held below the detergent box holder 255 and fixed to the top cover 25, a cover 74 (the first cover) arranged above the detergent box 71 by being supported by the detergent box holder 255 or inserted into the detergent box holder 255 and fixed to the detergent box 71, and a connection pipe 77 (the first connection pipe) connecting the detergent box 71 with the tub body 41.

In more detail, the detergent box 71 may be coupled to the detergent box holder 255 below the top cover 25.

The detergent box 71 may be provided as a storage body 711 (the first storage body) for providing a space where a detergent is stored. The storage body 711 may be provided in all shapes that may provide a space for storing the detergent. The detergent box 71 may include a body upper surface 712 (the first body upper surface) provided with an opened surface of the storage body 711, a body bottom 713 (the first body bottom) arranged below the detergent box holder 255, and a body side 714 (the first body side) provided along an edge of the body bottom, forming a space for storing the detergent, together with the body bottom 713.

The body upper surface 712 may surround an edge of the detergent box holder 255, and may be provided in all shapes that may communicate the inside of the storage body 711 with the outside of the top cover through the detergent box holder 255.

Figure 5:
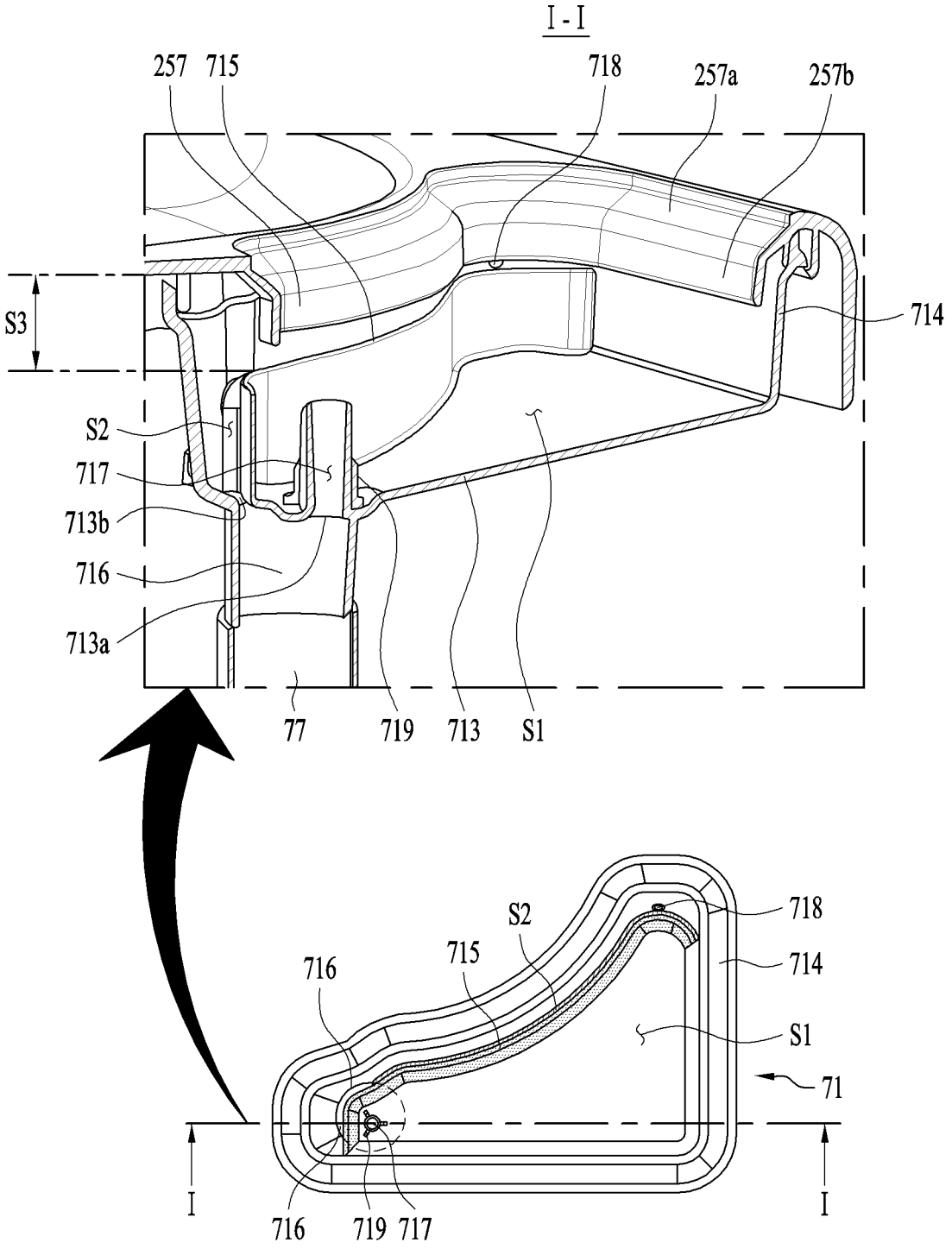
FIGS. 5 to 8 illustrate examples of a detergent supply unit provided in a laundry treating apparatus according to one embodiment of the present invention.

As shown in FIG. 5, the detergent box 71 may further include a barrier 715 for partitioning an inner space of the storage body 711 into a first space S1 (the first body first space) where the detergent is stored, and a second space S2 (the first body second space) detached from the first space, forming a path. The barrier 715 may be provided as a board extended from the body bottom 713 to the cover 74.

The first space S1 may be provided to be communicated with the tub body 41 through a first body through hole 713*a* (the first body first through hole) passing through the body bottom 713, and the second space S2 may be provided to be communicated with the tub body 41 through a second body through hole 713*b* (the first body second through hole) passing through the body bottom 713.

A first discharge pipe 717 (the first body first discharge pipe) is connected to the first body through hole 713*a*, and a second discharge pipe 716 (the first body second discharge pipe) is connected to the second body through hole 713*b*. The first discharge pipe 717 is a pipe protruded toward the body upper surface from the body bottom 713, and a liquid inside the first space S1 moves to the first body through hole 713*a* through the first discharge pipe 717.

One end of the connection pipe 77 may be fixed to the second discharge pipe 716. In this case, the first body through hole 713*a* may be provided to communicate the first space S1 with the second discharge pipe 716. Although not shown, the first body through hole 713*a* may be provided to directly supply the liquid (mixture of detergent and water), which is discharged from the first space S1, to the connection pipe 77 without passing through the second discharge pipe 716.

The first space S1 is supplied with water through a detergent box water supply nozzle 718 provided to pass through the body side 714, wherein the detergent box water supply nozzle 718 is connected to the water supply source through the first detergent water supply pipe 35.

As shown in FIG. 4, the cover 74 (the first cover) may be provided as a cover body 741 (the first cover body) inserted to the detergent box holder 255. The cover body 741 includes a cover bottom 743 (the first cover bottom) arranged above the storage body 711, a cover side 744 (the first cover side) fixed to the cover bottom, forming storage spaces together with the cover bottom, and a detergent inlet 742 provided on the cover body, allowing the detergent to enter the storage spaces 743 and 744.

The detergent box holder 255 may further include a guide 257 (the first guide) to allow the cover body 741 to be easily coupled to the detergent box holder 255. The guide 257 may be formed to be downwardly recessed from the periphery of the holder opening 255*a*. In more detail, the guide 257 may be provided as a board extended toward the inside of the first space S1 from the edge of the holder opening 255*a*. In this case, the cover side 744 may be provided in a shape that may be mounted on the guide 257. That is, the cover side 744 may be supported in the guide 257 and detachably be coupled to the detergent box holder 255.

The guide 257 may include a mounting rib 257*a* protruded from the edge of the detergent box holder 255 to the center of the detergent box holder 255, and an inlet rib 257*b* downwardly inclined from the mounting rib 257*a* to the center of the detergent box holder 255.

The mounting rib 257*a* adjoins the lower surface of the cover 71 to allow the cover 71 to be stably held in the detergent box holder 255. The inlet rib 257*b* is provided to surround the side of the cover 71 and prevents the cover 71 from moving in a horizontal direction.

The storage spaces formed by the cover bottom 743 and the cover side 744 are communicated with the first space S1 through a communication hole 745 (the first communication hole). Therefore, the detergent entering the storage spaces 743 and 744 of the cover body 741 through the detergent inlet 742 is moved to the first space S1 through the communication hole 745. To allow the detergent supplied to the storage spaces 743 and 744 to easily enter the first space S1, the cover bottom 743 may be provided to be downwardly inclined toward the communication hole 745.

The detergent inlet 742 may be provided as an opened surface formed on an upper surface of the cover body 741, or may be provided as a hole provided to pass through the upper surface of the cover body 741.

Figure 7:
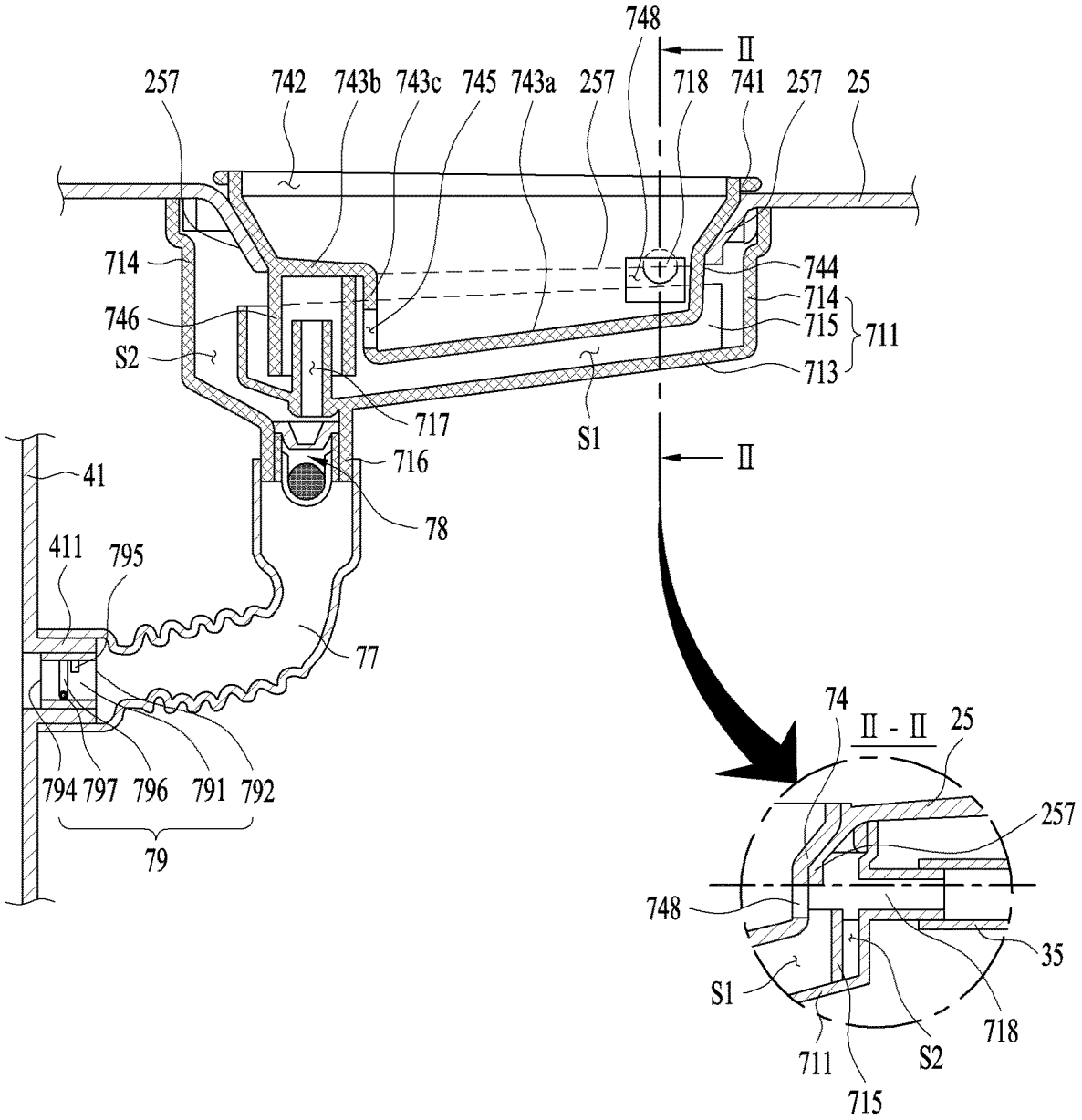

The first detergent supply unit 7 further includes a siphon formation pipe 746 (the first siphon formation pipe) for forming a siphon guider together with the first discharge pipe 717 provided in the storage body 711. The siphon formation pipe 746 is a means provided to surround the first discharge pipe 717, moving a liquid (mixture of detergent and water) inside the first space S1 to the first body through hole 713*a* if a water level inside the first space S1 is higher than a height of the first discharge pipe 717. FIG. 7 illustrates that the siphon formation pipe 746 is provided as a pipe protruded toward the body bottom 713 from the cover bottom 743 as an example.

In this case, the cover bottom 743 may include a first bottom 745*a*, a second bottom 743*b* provided to be higher than the first bottom, providing a space to which the siphon formation pipe 746 is fixed, and a connection surface 743*c* connecting the first bottom with the second bottom, provided with the communication hole 745. Preferably, the first bottom 743*a* is provided to be downwardly inclined toward the communication hole 745, and the second bottom 743*b* is provided to be downwardly inclined toward an upper end of the connection surface 743*c*.

The storage body 711 includes a spacer 719 which is a means for maintaining an interval between an inner circumferential surface of the siphon formation pipe 746 and an outer circumferential surface of the first discharge pipe 717 and an interval between a lower end of the siphon formation pipe 746 and the body bottom 713.

Meanwhile, a problem may occur in that the first detergent supply unit 7 having the aforementioned structure only fails to supply the detergent stored in the first space S1 to the tub 4 if the siphon guider is damaged (if the first body through hole is blocked, the siphon formation pipe is damaged, etc.). That is, if water is supplied to the first space S1, a risk occurs in that the detergent stored in the first space S1 may leak into the cabinet 1 together with the water through the communication hole 745 and the detergent inlet 742.

To solve the problem, the first detergent supply unit 7 includes a space communication unit (the first space communication unit) provided on the barrier 715, communicating the first space S1 with the second space S2.

As shown in FIG. 5, the space communication unit may be provided as a space S3 formed as a free end of the barrier 715 is higher than that of the first discharge pipe 717 and is lower than the detergent inlet 742.

If the barrier 715 is provided as a board extended toward the cover 74 from the body bottom 713 so that an upper end of the barrier 715 is in contact with the cover 74, the space communication unit may be provided as a barrier through hole provided to pass through the barrier 715. In this case, the barrier through hole should be provided to be higher than the free end of the first discharge pipe 717 and lower than the detergent inlet 742.

It is supposed that the aforementioned space communication unit S3 is provided in the barrier 715. In this case, if the liquid inside the first space S1 is not discharged to the outside of the first space S1 through the first body through hole 713*a*, the liquid inside the first space S1 is moved to the second space S2, and the liquid moved to the second space S2 will be supplied to the tub body 41 through the second body through hole 713*b* and the second discharge pipe 716. Therefore, the detergent supply unit provided in the present invention may supply the detergent to the tub body even though the siphon guider is damaged.

Meanwhile, since the first detergent supply unit 7 provided in one embodiment of the present invention has a structure that the detergent is stored in the first space S1 by being supplied to the communication hole 745 along the cover bottom 743, the detergent may remain in the cover bottom 743. If the detergent remains in the cover bottom 743, a sanitary problem may be caused. To solve the problem, the first detergent supply unit 7 may further include a cover water supply nozzle 748 (the first cover water supply nozzle) for preventing the detergent from remaining in the cover bottom 743.

Figure 6:
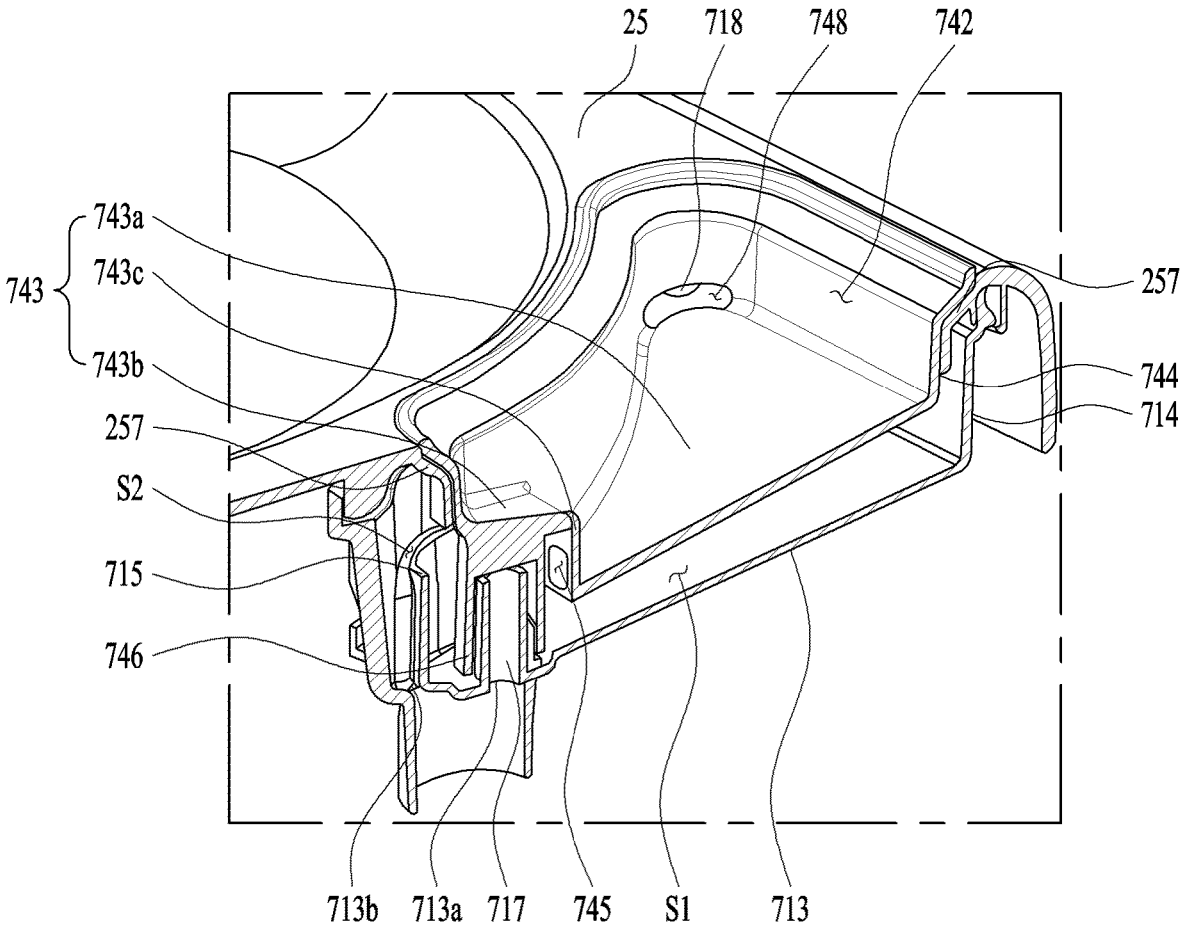

As shown in FIG. 6, the cover water supply nozzle 748 is a means provided to pass through the cover side 744, allowing the water supplied from the storage unit water supply nozzle 718 to partially enter the storage spaces formed by the cover bottom 743 and the cover side 744. Therefore, the water supplied to the first space S1 through the detergent box water supply nozzle 718 partially enters the cover body 741 through the cover water supply nozzle 748, and the water entering the cover body 741 will be supplied to the first space S1 through the communication hole 745 after washing the cover bottom 743. Therefore, in the present invention, the problem that the detergent remains in the cover body may be minimized.

Meanwhile, a water pressure of water supplied from the water supply source may be varied depending on zones where the laundry treating apparatus is provided. If a water pressure of the zone where the laundry treating apparatus is provided is high, a pressure of water supplied to the first space S1 through the detergent box water supply nozzle 718 will be high. Therefore, a problem may occur in that the water supplied to the first space S1 through the detergent box water supply nozzle 718 may detach the cover 74 from the detergent box holder 255 or discharge the detergent stored in the first space S1 to the outside of the first detergent supply unit 7.

Figure 8:
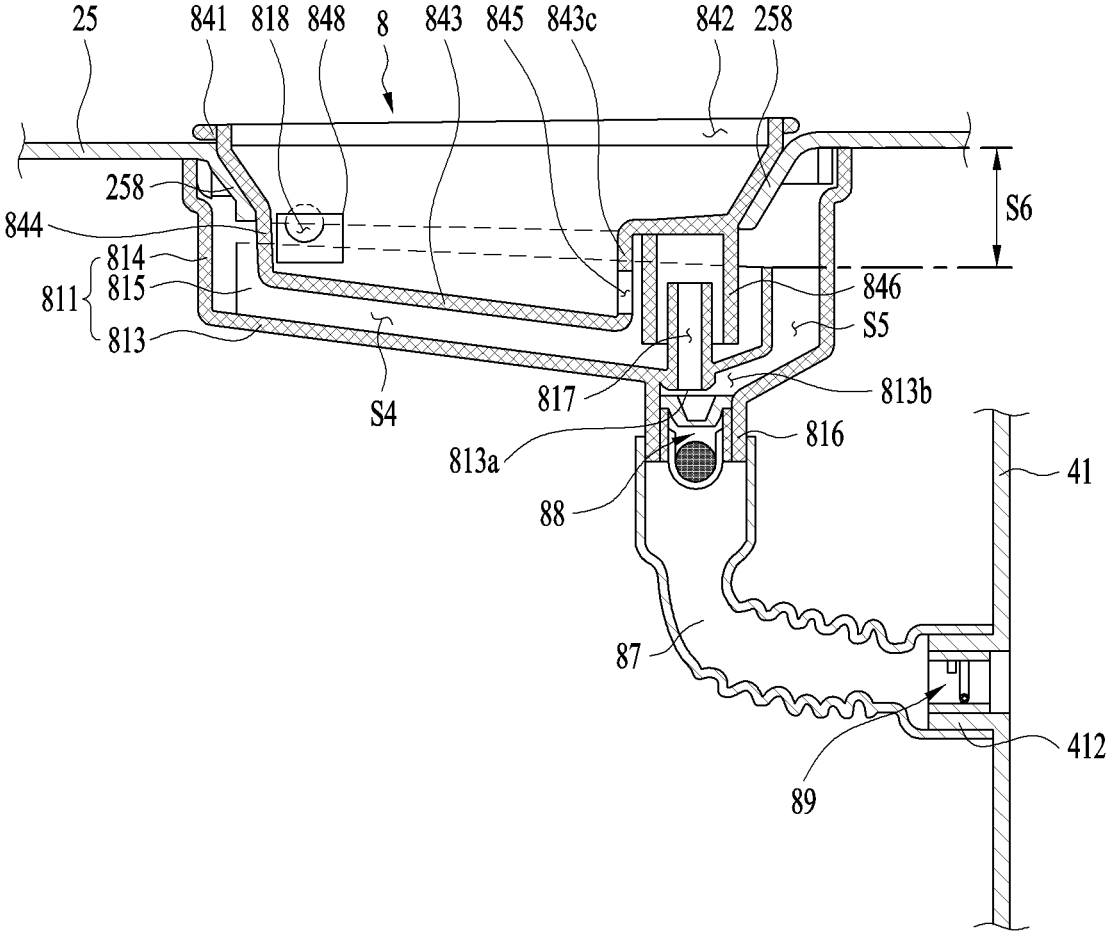

To solve the problem, a free end of the guide 257 may be provided to be arranged between the cover side 744 and the barrier 715, thereby attenuating a flow velocity of the water supplied from the detergent box water supply nozzle 718. That is, as shown in FIG. 8, the guide 257 may be extended toward the first space S1 from the detergent box holder 255 to close a partial area of the detergent box water supply nozzle 718 if the guider is projected in the cover side 744.

The first detergent supply unit 7 having the aforementioned structure supplies the detergent to the tub body 41 through the connection pipe 77 as described above, and a diameter of each bottom of the drum body 61 and the tub body 41 provided in the present invention is set to be longer than its height, whereby a problem may occur in that the water inside the tub body may backward flow toward the first detergent supply unit 7 through the connection pipe 77 when the drum body 61 is rotated. To solve this problem, the present invention may further include a first backward flow preventer 78 and a second backward flow preventer 79.

One end of the connection pipe 77 may be fixed to the second discharge pipe 716 and its other end may be fixed to a detergent inlet pipe 711 (the first detergent inlet pipe) provided to pass through the circumferential surface of the tub body 41. In this case, it is preferable that the first backward flow preventer 78 is fixed to the second discharge pipe 716 and the second backward flow preventer 79 is fixed to the detergent inlet pipe 411. This facilitates assembly of the backward flow preventers 78 and 79.

That is, if the backward flow preventers 78 and 79 are respectively provided in the second discharge pipe 716 and the detergent inlet pipe 411, they may be assembled more easily than the case that at least one of the backward flow preventers 78 and 79 is provided inside the connection pipe 77.

In the laundry treating apparatus 100 having the aforementioned structure only, a leakage may occur in that a small amount of water may enter the detergent water supply pipe 35 when the first valve 311 opens the first water supply pipe 31 in a state that the second valve 517 is damaged (abrasion of sealer). If the leakage occurs in the detergent water supply pipe 35, a problem may occur in that the detergent stored in the first detergent box supply unit 7 is not supplied to the tub 4 at a desired timing.

To solve the problem, as shown in FIG. 6, the detergent box water supply nozzle 718 provided in the first detergent supply unit 7 is preferably provided to pass through one surface of the storage body 711 for forming the second space S2 together with the barrier 715 among the space provided by the storage body 711. Also, the detergent box water supply nozzle 718 is preferably provided to be higher than the free end of the barrier 715 and lower than the detergent inlet 742 so that the water supplied from the detergent box water supply nozzle 718 may be supplied to the first space S1 by passing through the free end of the barrier 715.

The water supplied from the detergent box water supply nozzle 718 is supplied to the first space S1 by passing through the free end of the barrier 715 to allow the water discharged from the detergent box water supply nozzle 718 to enter the second space S2 if the pressure of the water discharged from the detergent box water supply nozzle 718 is low.

Therefore, the first detergent supply unit 7 provided in the present invention may prevent the detergent stored therein from being supplied to the tub at an unwanted timing even though the small amount of water leaks into the detergent water supply pipe 35 due to a minor damage of the second valve 517.

Moreover, the free end of the barrier 715 may be provided to be downwardly inclined toward a direction that the second body through hole 713*b* is arranged from a direction that the detergent box water supply nozzle 718 is arranged. This is to prevent the water from remaining in the second space S2.

FIG. 8 illustrates an example of the second detergent supply unit 8. The second detergent supply unit 8 provided in the present invention may have the same structure as that of the first detergent supply unit 7. That is, the second detergent supply unit 8 may include a second cover detachably coupled to the second detergent box holder 256 (see FIG. 1) provided to pass through a top cover, a second detergent box 81 fixed to the top cover 25 and arranged below the second detergent box holder 256, and a second connection pipe 87 guiding the detergent stored in the second detergent box to the tub body 41.

The second detergent box 81 may be provided as a second storage body 811 for providing a space where a detergent is stored. The second storage body 811 may include a second body upper surface provided with an opened surface, a second body bottom 813 arranged below the second detergent box holder 256, and a second body side 814 provided along an edge of the second body bottom, forming a space for storing the detergent, together with the second body bottom 813.

The second detergent box 81 may further include a second barrier 815 for partitioning an inner space of the second storage body 811 into a second detergent box first space S4 where the detergent is stored, and a second detergent box second space S5 detached from the second detergent box first space, forming a path. The second barrier 815 includes a second space communication unit S6. Since the second space communication unit 6 functions equally to the space communication unit S3 (the first space communication unit), its detailed description will be omitted.

The second detergent box first space S4 may be provided to be communicated with the tub body 41 through a second body first through hole 813*a* passing through the second body bottom 813, and the second detergent box second space S5 may be provided to be communicated with the tub body 41 through a second body second through hole 813*b* passing through the second body bottom 813.

A second body first discharge pipe 817 is connected to the second body first through hole 813*a*, and a second body second discharge pipe 816 is connected to the second body second through hole 813*b*. One end of the second connection pipe 87 may be fixed to the second body second discharge pipe 816. In this case, the second body first through hole 813*a* may be provided to communicate the second detergent box first space S4 with the second body second discharge pipe 816.

The second detergent box first space S4 is supplied with water through a second detergent box water supply nozzle 818 provided to pass through the second body side 814, wherein the second detergent box water supply nozzle 818 is connected to the water supply source through the second detergent water supply pipe 37. The second detergent box water supply nozzle 818 is preferably provided to pass through one surface of the second storage body 811 for forming the second detergent box second space S5 together with the second barrier 815 among the space provided by the second storage body 811. Therefore, the second detergent box water supply nozzle 818 is preferably provided to be higher than the free end of the second barrier 815 and lower than the second detergent inlet 842.

The second cover 84 may be provided as a second cover body 841 inserted to the second detergent box holder 256. The second cover body 841 includes a second cover bottom 843 arranged above the second storage body 811, a second cover side 844 fixed to the second cover bottom, forming second storage spaces together with the second cover bottom, and a second detergent inlet 842 provided on the second cover body, allowing the detergent to enter the second storage spaces 843 and 844.

The second detergent box holder 256 may further include a second guide 258 to allow the second cover body 841 to be easily coupled to the second detergent box holder 256. The second guide 258 may be provided as a board extended toward the inside of the second detergent box first space S4 from the edge of the second detergent box holder 256. In this case, the second cover side 844 may be supported in the second guide 258 and detachably be coupled to the second detergent box holder 256. Since a shape and function of the second guide 258 are the same as those of the first guide 257 of the first detergent supply unit 7, their detailed description will be omitted.

The second storage spaces 843 and 844 are communicated with the second detergent box first space S4 through a second communication hole 845 provided on a second connection surface 843*c*. Therefore, the detergent entering the storage spaces of the second cover body 841 through the second detergent inlet 842 is moved to the second detergent box first space S4 through the second communication hole 845. Since a structure of the second cover bottom 843 is the same as that of the first cover bottom 743, its detailed description will be omitted.

The second detergent supply unit 8 further includes a second siphon formation pipe 846 coupled to the second body first discharge pipe 817 provided in the second storage body 811 to guide a siphon phenomenon. Since a function and shape of the second siphon formation pipe 846 are the same as those of the first siphon formation pipe 746, their detailed description will be omitted.

Meanwhile, the second detergent supply unit 8 may further include a second cover water supply nozzle 848 for preventing the detergent from remaining in the second cover bottom 843. The second cover water supply nozzle 848 is provided to implement the same effect as that of the cover water supply nozzle 748 of the first detergent supply unit.

The second connection pipe 87 is provided to connect the second body second discharge pipe 826 with the second detergent inlet pipe 412 provided in the tub body, and the second body second discharge pipe 816 may include a second detergent box first backward flow preventer 88, and the second detergent inlet pipe 412 may include a second detergent box second backward flow preventer 89. The second detergent box first backward flow preventer 88 and the second detergent box second backward flow preventer 89 may be provided to have the same structures as those of the first backward flow preventer 78 and the second backward flow preventer 79.

Hereinafter, the top cover 25 will be described in more detail with reference to FIGS. 9 to 11.

In the aforementioned embodiment, the drawer body 21, the tub 4 provided inside the drawer body 21, the drum 6 provided inside the tub, and the top cover 25 covering the upper portion of the drawer body 21 have been described.

Since the drawer body 21 is an element for receiving the tub 4 and the drum 6, the drawer body 21 may be referred to as a housing. A laundry treating apparatus provided with a housing provided slidably with respect to the cabinet 1 is shown in FIG. 2. However, the housing may be replaced with the cabinet. In this case, in the same manner as a general top loading washing machine, the laundry treating apparatus may be provided as a washing machine in which a tub 4 and a drum 6 are always arranged inside a cabinet. Also, in the same manner as the embodiment shown in FIG. 17, an upper portion of one cabinet 1 may be replaced with the drawer body 21.

Since the laundry treating apparatus according to this embodiment has a relatively small size, an inner space between the cabinet and the tub or an inner space between the drawer body 21 (housing) and the tub may be very narrow. Therefore, it is not easy to mount various wires or pipes in the inner space. Particularly, if a structure for supplying a detergent to the top cover 25 is provided in the same manner as the aforementioned embodiment, water supply pipes for supplying washing water to the detergent box should be provided, whereby the components are complicated and their assembly is not easy. Also, although a pipe for communicating the detergent box with the tub should be provided, a working space is not sufficient, whereby assembly is not easy.

Therefore, in the laundry treating apparatus according to this embodiment, it is intended that various components may be fixed to the tub cover 25 and then the tub cover 25 may be fixed to the drawer body. Particularly, the present invention is intended to provide the laundry treating apparatus having excellent assembly in such a manner that the tub 4 and the drum 6 may be fixed into the drawer body 21 and then the tub cover 25 may be fixed to the drawer body 21.

Figure 9:
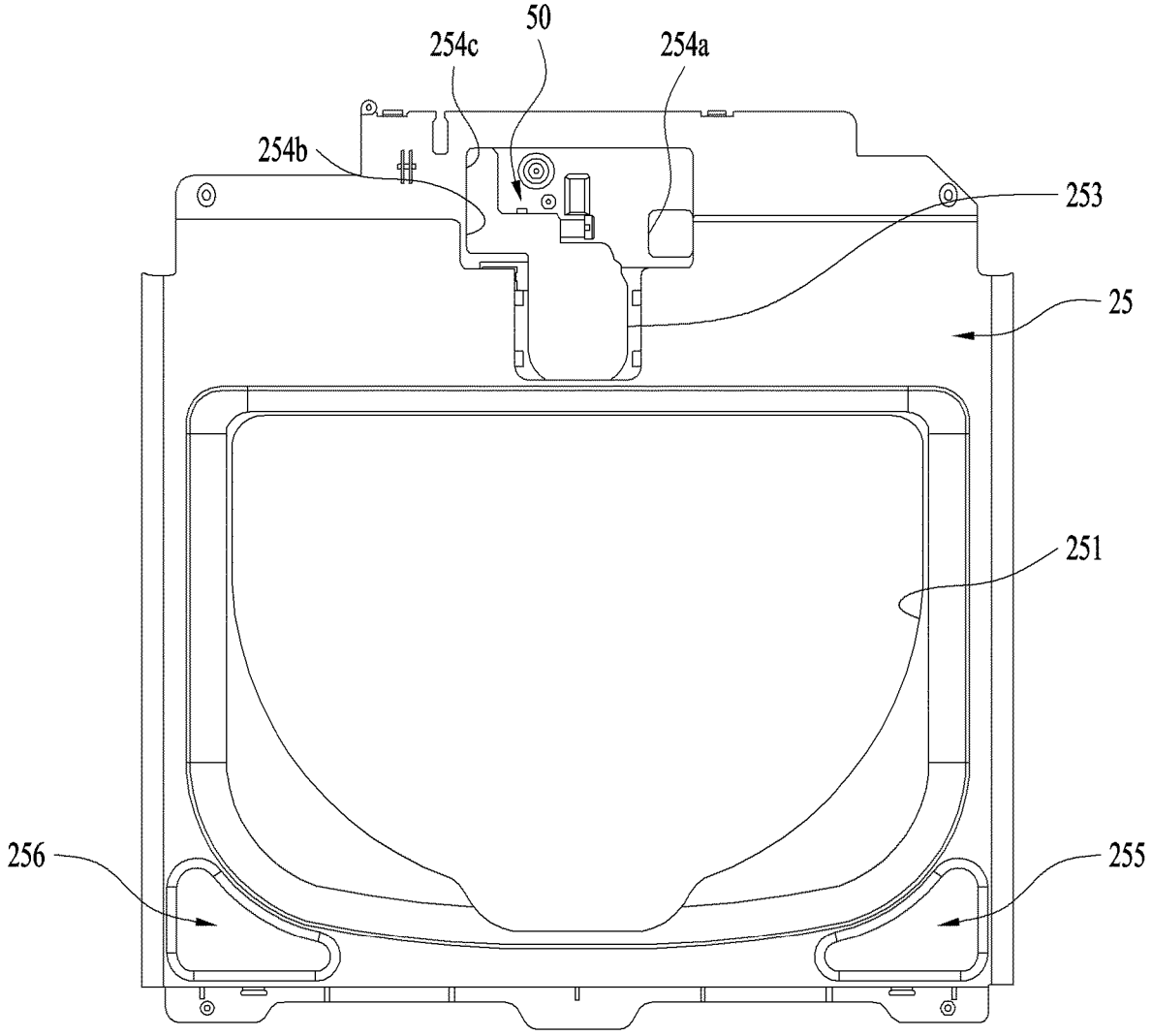
FIG. 9 is a plane view illustrating a top cover of a laundry treating apparatus according to one embodiment of the present invention.

As shown in FIG. 9, the tub cover 25 may be a single component formed in a single body by injection.

Since the tub cover 25 is configured to cover the housing or the drawer body 21, it is required to put or take laundry into or out of the drum 6 from the outside of the drawer body 21 to the inside of the drawer body 21. To this end, an opening or through hole 251 is formed at the center of the tub cover 25.

The tub cover 25 may be formed to have a rectangular shaped plane. This because that the laundry treating apparatus generally has a rectangular plane and the tub cover 25 is formed to be matched with a shape of an upper surface of the laundry treating apparatus.

The detergent box holders 255 and 256 may be formed at one side or both side corners of the front of the tub cover 25. The detergent box holders 255 and 256 may be formed only at any one of both side corners. The detergent box holders may be formed in the form of an opening passing through the tub cover 25 up and down. This is intended to allow the user to put a detergent into the detergent box holder from the upper portion to the lower portion.

The upper surface of the tub cover 25 may be a portion exposed to the user when the user puts or takes laundry into or out of the tub or puts a detergent into the detergent box. However, components for supplying washing water into the tub through the tub cover are not those manipulated by the user. Therefore, it is preferable that these components are not exposed to the user. Preferably, some of the upper surface of the tub cover 25 is not exposed to the user.

To this end, it is preferable that a structure for fixing various components related to water supply is provided at the rear of the tub cover 25.

In more detail, it is preferable that a distributor holder 50 is provide at the rear of the tub cover 25. That is, the distributor holder 50 is provided at the rear of the through hole 251 for putting or taking laundry thereinto or out thereof. The distributor holder 50 may be formed to held the aforementioned distributor 5 at the upper portion of the tub cover 25.

Pass through portions 254*a*, 254*b* and 254*c* for passing through wires and water supply pipes may be formed in the periphery of the distributor holder 50. The pass through portions 254*a*, 254*b* and 254*c* may be provided to pass through the upper and lower portions of the tub cover.

The distributor 5 is held on the distributor holder 50. The distributor 5 may be fixed to the distributor holder 50 in a state that the second valve 517 is fixed thereto. Therefore, it may be regarded that the distributor 5 includes the second valve 517.

The detergent water supply pipes 35 and 37 for supplying washing water to the detergent box may be connected to the distributor 5. As described above, the detergent water supply pipes are connected with the detergent box 71 arranged below the tub cover 25. Preferably, the detergent water supply pipes 35 and 37 are provided not to be visible to the user.

Therefore, it is preferable that the detergent water supply pipe passing through portions 254*a* and 254*b* are formed in the distributor holder 50. The detergent water supply pipes may be extended to pass through the lower portion of the top cover from the upper portion of the top cover through the detergent water supply pipe pass through portions.

The tub water supply pipe 33 is connected to the front of the distributor 5. The tub water supply pipe 33 is configured to supply washing water to the tub 4 arranged below the tub cover 25. Therefore, the tub water supply pipe 33 should be extended from the distributor 5 fixed onto the tub cover 25 to the lower portion of the tub cover 25. To this end, a tub water supply pipe pass through portion which is the second opening 253 may be formed at the front of the distributor holder 50.

The valve pass through portion 254*c* for insertion of the second valve 517 may be formed in the distributor holder 50. The second valve 517 may be a solenoid valve, and a height of the second valve 517 may be higher than that of the distributor. Therefore, the second valve 517 may be fixed to the distributor holder 50 in a state that the second valve 517 has partially passed through the vale pass through portion 254*c*.

Figure 10:
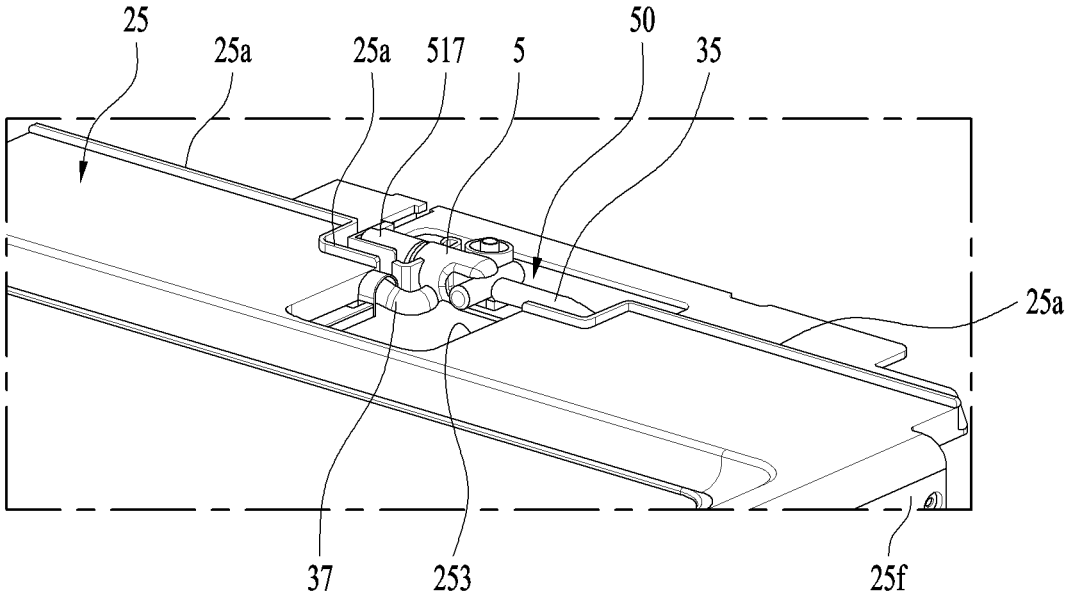
FIG. 10 illustrates that a distributor is provided in a distributor holder of a cop cover shown in FIG. 9.

FIG. 10 illustrates that the distributor 5 and the detergent water supply pipes 35 and 36 are fixed to the tub cover 25. As shown, the detergent water supply pipes 35 and 37 are partially exposed to the upper portion of the tub cover 25. Since the rear of the tub cover 25 is not almost visible to the user, the distributor 5 and the detergent water supply pipes 35 and 37 are not visible to the user. FIG. 1 may correspond to the state that the drawer body 21 is ejected within a maximum range if possible. As shown, the distributor 5 and the detergent water supply pipes 35 and 37 are not exposed externally.

The front of the tub cover 25 is exposed externally. Particularly, the front of the tub cover 25 is exposed to the periphery of the opening 25. Therefore, water may enter the periphery of the opening 251 on the tub cover 25. Water generated by wet laundry or water generated in the middle of cleaning the outside of the washing machine may enter the upper portion of the tub cover 25. In this case, the water may flow toward the rear of the tub cover 25. Particularly, the water may enter the second valve 517, whereby the valve may be out of order or may be operated in error. Therefore, it is preferable that a rear rib 25*a* upwardly protruded is formed at the rear of the tub cover 25. That is, the rear rib 25*a* may be formed on the rear of the tub cover.

The rear rib 25*a* may be formed to be extended toward both sides to prevent the water from flowing the front to the rear. Particularly, the rear rib 25*a* may be formed to partition the distributor holder 50 in a front and rear direction.

The rear rib 25*a* may be formed to be extended from both sides of the distributor holder to the upper portion thereof.

The water may be discharged out by flowing toward both sides of the tub cover 25 through the rear rib 25*a*. Also, the water may enter the tub water supply pipe pass through portion 253 along the rear rib 25*a*.

Figure 11:
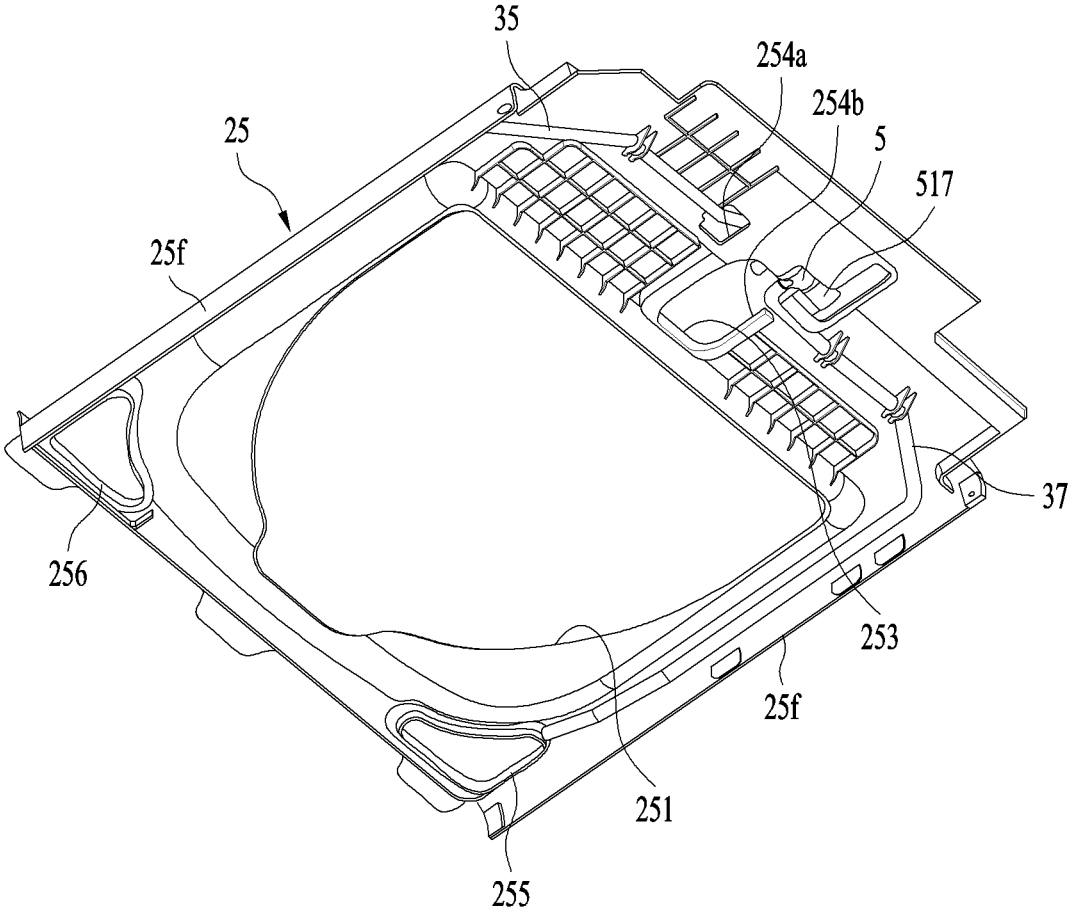
FIG. 11 is a lower perspective view illustrating a top cover shown in FIG. 10.

As shown in FIG. 11, the detergent water supply pipes 35 and 37 extended to the lower portion of the tub cover 25 are fixed to the lower surface of the tub cover 25. To this end, detergent water supply pipe holders 35*a* and 37*a* may be formed on the lower surface of the tub cover 25. The detergent water supply pipe holders 35*a* and 37*a* may be provided in the form of multiple hose hangers 35*b* and 37*b*. The detergent water supply pipes 35 and 37 are extended to the detergent box 71 in a state that they are fixed to the hose hangers.

A length between the distributor 5 and the detergent box 71 is relatively long. Therefore, the detergent water supply pipes may be gone down or move depending on their weight and water supply. Therefore, it is preferable that a plurality of hose hangers are provided in an extension direction of the detergent water supply pipes to fix the detergent water supply pies at a plurality of fixed points. As a result, the detergent water supply pies may be fixed to the tub cover 25 and may be regarded as one assembly together with the tub cover 25.

Figure 12:
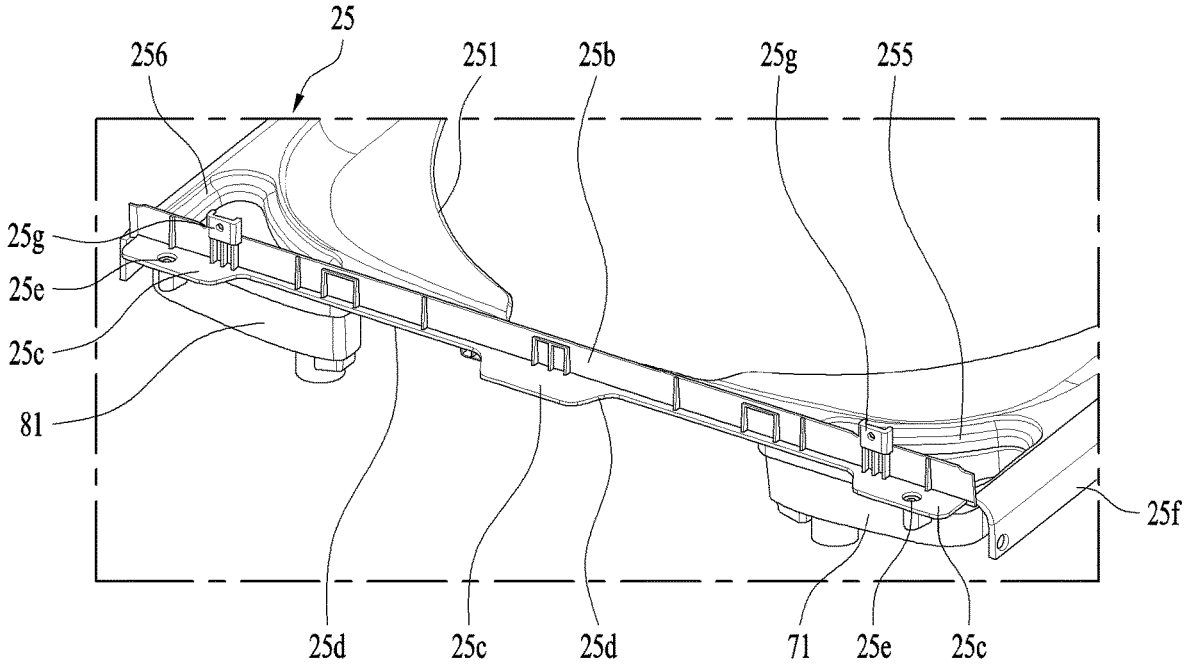
FIG. 12 illustrates that a detergent box is provided in a detergent box holder of a top cover shown in FIG. 9.

As shown in FIG. 12, the detergent box 71 and 81 are fixed to the lower portion of the tub cover 25. That is, the detergent boxes are fixed to the detergent box holders formed in the tub cover 25. Although not shown, the detergent box 71 may be fixed to the tub cover 25, and the detergent water supply pies 35 and 37 may be connected with the detergent boxes 71 and 81 below the tub cover 25.

Therefore, the tub cover 25 may be regarded as one assembly in which the distributor 5, the detergent boxes 71 and 81 and the detergent water supply pipes 35 and 37 are fixed. That is, the distributor 5 and the detergent boxes 71 and 81, which are fixed to the tub cover 25, may be connected with each other by the detergent water supply pies 35 and 37, whereby the detergent water supply pies may be fixed to the tub cover 25. This one assembly may be coupled to or detached from the housing or the drawer body 21, thereby facilitating assembly and later management.

Meanwhile, water or detergent (especially, liquid detergent) may flow to the periphery of the opening 251 or the periphery of the detergent box holders 255 and 256 on the tub cover 25. Although described later, a control panel 231 may be fixed to the front or an upper portion of the front of the tub cover 25. Since control components are provided in the control panel 231, it is required to block the water or detergent from flowing to the front of the tub cover 25.

To this end, it is preferable that a front rib 25*b* upwardly protruded is formed on the tub cover 25. The front rib 25*b* is extended to both sides to prevent the water or detergent from flowing from the rear to the front. Particularly, since the front rib 25*b* is provided at the front of the detergent box holders 255 and 256, if the user puts a liquid detergent, a liquid bleach or a liquid softener into the detergent box in error, the front rib 25*b* may prevent it from entering the front.

The tub cover 25 may include a mounting rib 25*c* horizontally extended to the front of the front rib 25*b*. The mounting rib 25*c* may be formed at the front of the top cover 25, and may constitute a front upper surface of the top cover. However, the mounting rib 25*c* may not be exposed externally by coupling with the control panel. That is, the mounting rib 25*c* may be coupled with the control panel 231 below the control panel to support the control panel 231.

The mounting rib 25*c* may be provided to be mounted on the drawer body 21 at the upper portion of the drawer body 21. That is, when the top cover 25 is coupled with the drawer body 21, the mounting rib 25*c* may be provided to adjoin the top cover 25. Therefore, the top cover 25 may be supported in the drawer body 21 by the mounting rib 25*c*.

A support point supported in the top cover 25 at the front of the top cover 25 may be formed through the number of mounting ribs 25*c*. The mounting rib 25*c* may be formed at both sides and the center of the top cover 25. Therefore, the top cover 25 may stably be supported by the top cover 25.

A cutting portion 25*d* may be formed between the mounting ribs 25*c*. That is, the structure of the mounting rib 25*c* extended from the front rib 25*b* to the front may be excluded from the portion corresponding to the cutting portion 25*d*. The cutting portion 25*d* may be formed at both sides of the mounting rib 25*c* formed at the center of the top cover 25.

The cutting portion 25*d* may form a space that externally exposes the drawer body 21 when the top cover 25 covers the drawer body 21.

The mounting rib 25*c* provided at both sides of the top cover 25 may be coupled with the detergent box 81. To this end, a coupling hole 25*e* may be formed at the mounting rib 25*c*. Likewise, the mounting rib 25*c* provided at a right side of the top cover 25 may be coupled with the detergent box 71. To this end, the coupling hole 25*e* may be formed at the mounting rib 25*c*.

The detergent boxes 71 and 81 may be arranged to be more extended to both sides and the center of the top cover 25 in a state that they are coupled with the mounting ribs. Therefore, the detergent boxes 71 and 81 may be approached as those arranged below the top cover 25 through the cutting portion 25*d* and arranged in the inner space of the drawer body 21. That is, a worker's hand or assembler's hand may be inserted into the detergent box from the outside of the top cover 25 and the drawer body 21. This means that pipe connection between the detergent box and the tub may be made after assembly of the drawer body 21 and the top cover 25 as described later.

Also, the mounting rib 25*c* may be configured such that the control panel 231 is coupled from the upper portion of the mounting rib 25*c* to the lower portion thereof. Therefore, a vertical coupling portion to which the control panel 231 is coupled may be formed in the mounting rib.

And, a horizontal coupling portion 21*g* to which the control panel 231 is coupled at the front may be formed in the front rib 25*b*.

Hereinafter, external components of the laundry treating apparatus and coupling relation therebetween will be described in detail with reference to FIG. 13.

The drawer body 21 or the housing is formed to include front and rear and left and right sidewalls, and has a space therein. The upper surface of the drawer body 21 is opened.

The drawer body 21 may be formed in such a manner that front and rear and left and right sidewalls are formed integrally by injection molding. That is, the drawer body 21 may be formed in a single body.

The drum 6 and the tub 4 are fixed to the inner space of the drawer body 21. A drawer panel 23 is coupled to the front of the drawer body 21. If the drawer body 21 moves slidably from the cabinet 1, a part of the drawer body 21 and a part of the top cover 25 may selectively be exposed to the outside of the cabinet 1. However, the drawer panel 23 may be a portion always exposed from the front of the cabinet 1.

The control panel 231 may be fixed to the upper portion of the drawer panel 23, the front upper portion of the drawer body 21 and the front of the top cover 25. Also, a coupling rib 25*f* downwardly extended may be formed at both sides of the top cover 25. The coupling rib 25*f* may be formed to be downwardly bent from both ends on the top cover 25. The coupling rib 25*f* may be provided to partially cover left and right sidewalls of the drawer body 21, whereby the top cover 25 may be coupled with both sidewalls of the drawer body 21 through the coupling rib 25*f*.

However, after the drum 6 and the tub 4 are fixed to the drawer body 21, if the top cover 25 and the control panel 231 are fixed to the drawer body 21, it is not easy to connect the connection pipes 77 and 87 between the tub 4 and the detergent boxes 71 and 81. This is because that the detergent boxes 71 and 81 are arranged in the drawer body 21 as the top cover 25 is fixed to the drawer body 21 after the detergent boxes 71 and 81 are fixed to the top cover 25.

To facilitate connection of these connection pipes 77 and 87, an entrance space 21*e* is preferably formed between the top cover 25 and the drawer body 21.

Figure 14:
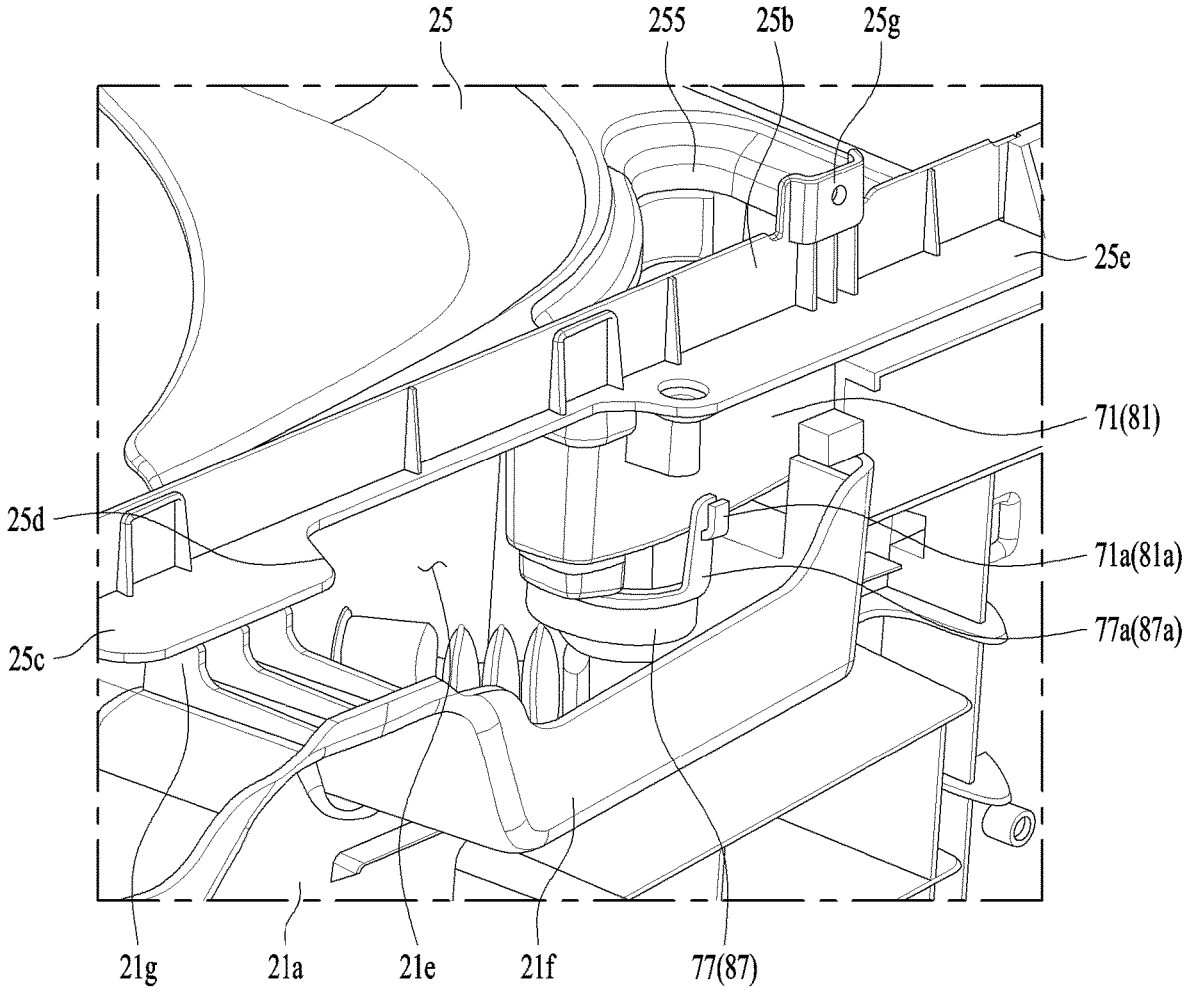
FIG. 14 illustrates a coupling between a top cover and a housing.

As shown in FIG. 14, the cutting portion 25*d* is formed in the top cover 25, whereby the cutting portion 25*d* may form such an entrance space 21*e*. However, the entrance space 21*e* may be increased in accordance with increase of a front and rear width of the cutting portion 25*d* but a problem occurs in that a front and rear width of the top cover 25 is more increased.

Therefore, an extension portion 21*f* may be formed above a front sidewall 21*a* of the drawer body 21 or the housing. The extension portion 21*f* may be formed in the form of pocket. That is, the extension portion 21*f* extended to the front of the front sidewall 21*a* may be formed to have an opened shape at an upper portion. Therefore, the extension portion 21*f* may be formed to have a front and rear spacing and an up and down spacing from the top cover 25. That is, the entrance space 21*e* may be formed from the front upper portion of the drawer body 21 to the inside of the housing. In this case, the cutting portion 25*d* may serve to extend the entrance space more and more.

At least a part of the detergent boxes 71 and 81 may be exposed externally through the entrance space 21*e*. The entrance space 21*e* may have a size to which the worker's hand or fingers may be inserted. First of all, since one end of the connection pipes 77 and 87 is connected to the tub 4, the other end of the connection pipes 77 and 87 may be connected to the detergent boxes 71 and 81 through the entrance space 21*e*.

To this end, hooks 77*a* and 87*a* may be provided at the other end of the connection pipes 77 and 87, and hooking portions 71*a* and 81*a* may be formed in the detergent boxes 71 and 81. The worker may complete connection of the connection pipes by fixing the hooks to the hooking portions after connecting the other end of the connection pipes 77 and 87 with the detergent boxes 71 and 81. The connection pipes may be prevented from being detached from the detergent boxes even though vibration is generated by coupling of the hooks and the hooking portions.

The connection pipes may be provided in the form of bellows. Therefore, a connection portion where the connection pipes are connected with the detergent boxes is preferably arranged at the rear of the extension portion 21*f*.

The top cover 25 may not be supported in the drawer body 21 due to the extension portion 21*f* This is because that the extension portion 21*f* forms the entrance space 21*e* at the front and the rear and up and down between the top cover 25 and the drawer body 21.

However, the extension portion 21*f* may be formed at a portion only along a left and right length of the top cover 25 or the drawer body 21. That is, the extension portion 21*f* may be formed at a portion only of both sides of the left and right center. That is, the extension portion 21*f* may form only the space for connecting the connection pipes 77 and 87.

Therefore, it is preferable that the top cover 25 is supported by the drawer body 21 at the center and both sides of the front of the drawer body 21.

The mounting rib 25*c* formed at the center of the top cover and the mounting rib 25*c* respectively formed at both sides of the top cover 25 may be supported by the drawer body 21. The extension portion 21*f* may be formed between the center mounting rib 25*c* and the right mounting rib 25*c*. Likewise, the extension portion 21*f* may be formed between the center mounting rib 25*c* and the left mounting rib 25*c*.

To support the top cover 25, a support rib 21*g* upwardly extended may be formed in the top cover 25. The support rib 21*g* may be a rib formed in the drawer body 21 in a single body, and may be extended upwardly to support the top cover 25 on the lower surface of the mounting rib 25*c* of the top cover 25. The support rib 21*g* may be formed to correspond to each mounting rib 25*c*.

Therefore, the top cover 25 may stably be coupled with the drawer body 21 by the structure of the top cover 25 and the drawer body 21, and then the connection pipe between the tub and the detergent box may be coupled through the extension portion 21*f*.

Afterwards, the drawer panel 23 and the control panel 213 may be coupled to the top cover 25 and the drawer body 21. As a result, assembly of basic external components of the laundry treating apparatus may be completed.

The support rib 21*g* may be formed with a plural number. That is, a plurality of support ribs 21*g* may be arranged at both sides. The support ribs may be formed to have a spaced interval at both sides.

A fitting boss of the detergent box may be inserted into the support ribs and the spaced interval. A fitting hole of the top cover may be arranged on a portion corresponding to the fitting boss. Therefore, the plurality of support ribs may support the top cover and form the space where the detergent box may be coupled to the top cover. Since the fitting boss of the detergent box is fixed by being inserted between the support ribs, the detergent box may be fixed more rigidly.

Since the laundry treating apparatus is a drawer type, the laundry treating apparatus may be fixed into the cabinet.

If the drum of the laundry treating apparatus is driven, the housing 21 as well as the drum and the tub may be vibrated. This vibration of the housing may include front and rear vibration, up and down vibration and left and right vibration.

In this case, a structure for attenuating the front and rear vibration and left and right vibration of the housing may be formed between the housing 21 and the cabinet 1.

In more detail, the front portion of the drawer body 21, especially the front sidewall 21*a* to which the drawer panel 23 is fixed is not inserted into the cabinet. That is, even though the drawer body 21 is inserted into the cabinet 1 within a maximum range, the front sidewall 21*a* of the drawer body 21 is partially blocked by the outlet 11 of the cabinet 1 and therefore is not inserted into the cabinet 1 anymore.

Therefore, the state that the drawer body 21 is inserted into the outlet within a maximum range will be the time when the laundry treating apparatus is operated. At this time, the front sidewall 21*a* of the drawer body 21 is in contact with the cabinet 1 of the outlet portion. Therefore, it is required to attenuate up and down movement and left and right movement of the drawer body 21 in a state that the front sidewall 21*a* is in contact with the cabinet 1.

To this end, a protrusion 1*a* may be formed in the cabinet 1 corresponding to the outlet 11, and a protrusion receiving portion 26 may be formed at the front sidewall 21*a* to correspond to the protrusion 1*a*. The protrusion may be protruded toward the front, and the protrusion receiving portion 26 may be formed in such a manner that some of the sidewall is opened and a diameter is enlarged in accordance with increase of an insertion length of the protrusion. The protrusion receiving portion 26 may be formed such that its diameter is increased in accordance with increase of the insertion length of the protrusion 1*a*.

Therefore, if the protrusion 1*a* is inserted from the rear of the protrusion receiving portion 26 to the front thereof, up and down movement and left and right movement of the protrusion 1*a* may be restricted by the protrusion receiving portion 26 in a state that the protrusion 1*a* is inserted to the protrusion receiving portion 26. The up and down movement and left and right movement of the protrusion 1*a* inside the protrusion receiving portion 26 may be permitted to be elastically restored. Therefore, up and down and right left vibration of the drawer body 21 may be attenuated.

In this case, the protrusion receiving portion 26 may be formed in a single body with the drawer body 21. That is, the protrusion receiving portion 26 may be formed in a single body by injection as a partial component of the drawer body 21.

The protrusion 1*a* and the protrusion receiving portion 26 may be formed respectively at both sides of the laundry treating apparatus. Particularly, the protrusion 1*a* and the protrusion receiving portion 26 may be formed respectively at both sides below the laundry treating apparatus. The protrusion 1*a* and the protrusion receiving portion 26 may be formed respectively at both sides even on the laundry treating apparatus.

Since the protrusion receiving portion 26 may be formed in a single body with the drawer body 21, the protrusion receiving portion 26 is not required to be separately provided, whereby manufacture and configuration may be simplified.

Figure 15:
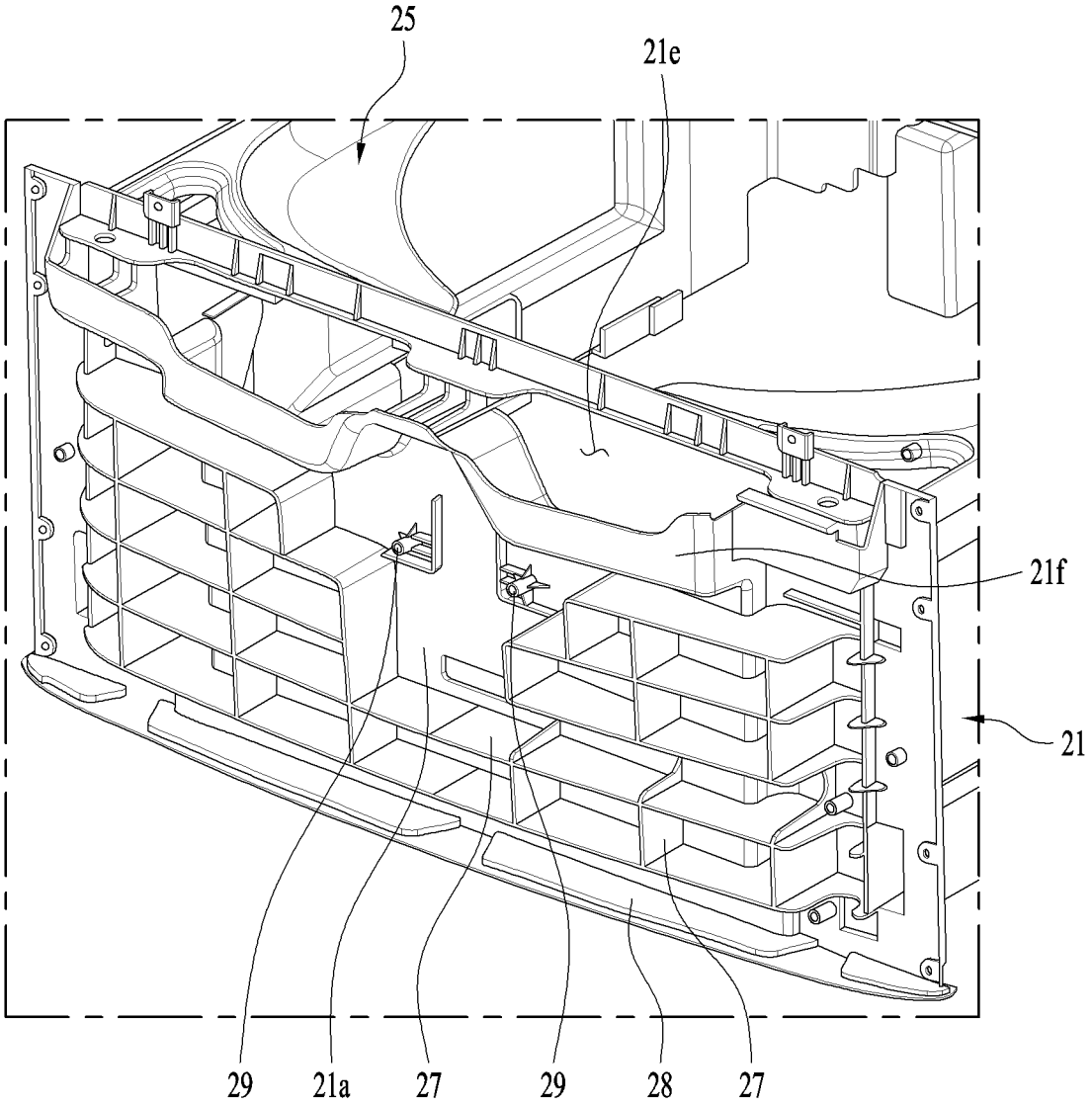
FIG. 15 is an enlarged view illustrating an enlarged portion in a coupling portion between a top cover and a housing.
Figure 16:
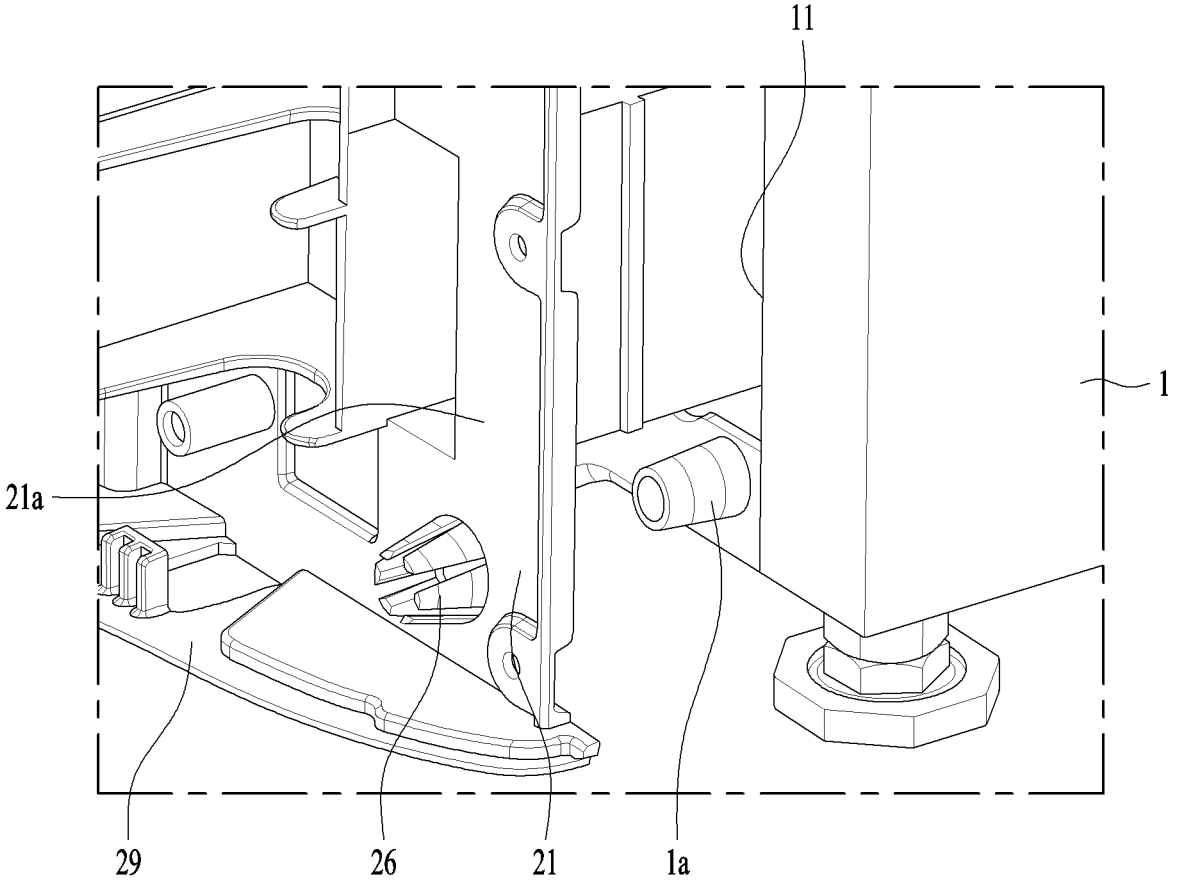
FIG. 16 is an enlarged view illustrating a protrusion and a protrusion receiving portion between a cabinet and a housing.

As shown in FIG. 15, an interval support rib 27 may be formed on the entire surface of the front sidewall 21*a* of the drawer body 21 in a single body with the drawer body 21. The interval support rib 27 may be formed in a horizontal type or vertical type by injection to be a single body with the drawer body 21. The interval support rib 27 may be formed in a grid type in which horizontal and vertical types are implemented in combination.

The interval support rib 27 may be formed between the rear surface of the drawer panel 23 and the front surface of the front sidewall of the drawer body 21 to maintain a spaced interval. As shown in FIG. 13, the drawer panel 23 is formed in a plate shape, preferably to have a volume. Since the drawer panel 23 is exposed to the outside of the cabinet, the user may eject or insert the laundry treating apparatus by holding the drawer panel 23.

Therefore, volume of the drawer panel 23 may be formed by the interval support rib 27.

The lower portion of the drawer panel 23 is blocked by a downward rib 28 formed below the front sidewall 21*a*. The upper portion of the drawer panel 23 is blocked by the control panel 231. In other words, a space is formed between the drawer panel 23 and the drawer body 21 to form a volume of the drawer panel 23. This space is maintained by the interval support rib 27. An upper portion of the space formed between the drawer panel 23 and the drawer body 21 is blocked by the control panel 231, and a lower portion of the space is blocked by the downward rib 28 of the drawer body 21.

Therefore, the interval support rib 27 and the downward rib 28 of the drawer body 21 may be formed in a single body with the drawer body 21, whereby a volume of the drawer body may be formed more easily. This means that a separate component is prevented from being interposed to form a volume, whereby manufacture may be easy and configuration may be simplified. Also, this means that the drawer panel 23 may directly be coupled to the drawer body 21.

Figure 13:
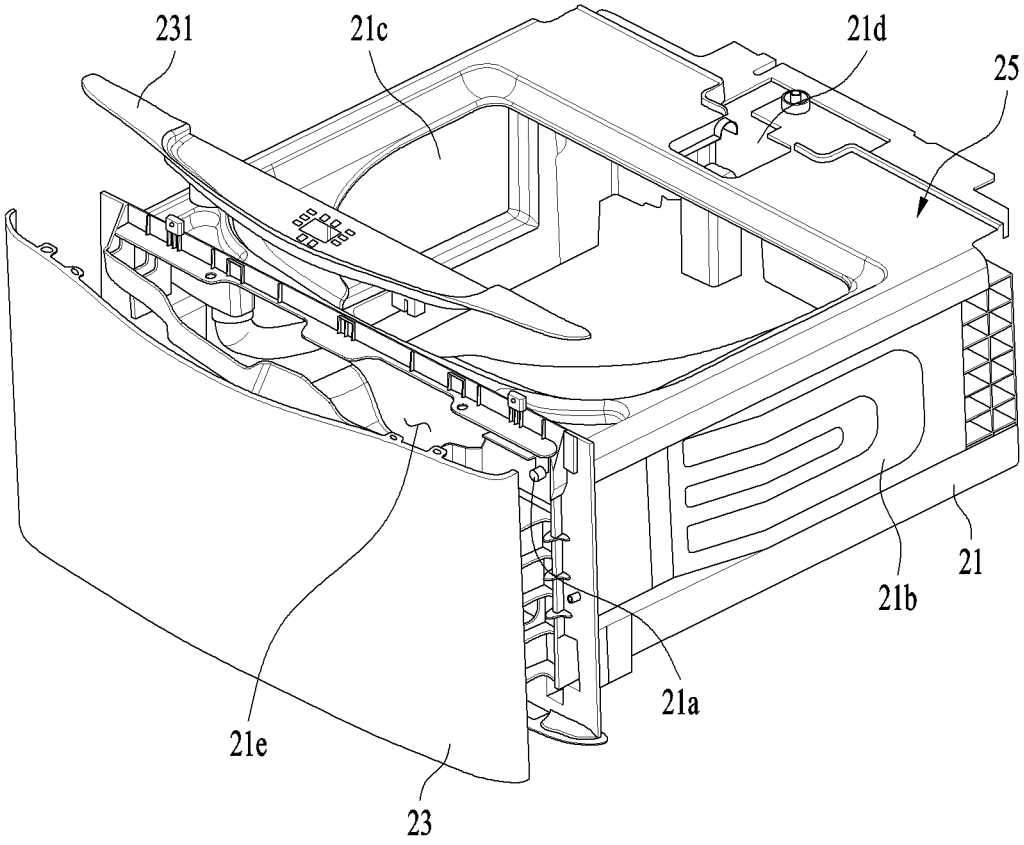
FIG. 13 is an exploded perspective view illustrating external partial components of a laundry treating apparatus according to one embodiment of the present invention.

Meanwhile, as shown in FIG. 13, the control panel 231 may be coupled with the drawer panel 23 and the top cover 21. The control panel 231 may be coupled with the top cover 21 and the drawer panel 23 at the upper portion of the extension portion 21*f* Therefore, the control panel 231 blocks the spaced interval between the drawer body 21 and the drawer panel 23. The control panel 231 blocks the spaced interval between the top cover 21 and the drawer body 21.

Particularly, the extension portion 21*f* is formed in the form of pocket protruded from the front sidewall 21*a* of the drawer body 21 to the front. A protrusion length of the extension portion 21*f* may be the same as or similar to that of the aforementioned interval support rib 27. That is, the extension portion 21*f* may be provided to maintain the interval between the front sidewall 21*a* of the drawer body 21 and the drawer panel 23 together with the interval support rib 27.

A fitting portion 29 may be formed at the front sidewall of the drawer body 21. A boss type fitting portion 29 may be formed. The drawer panel 23 may be fixed to the front of the front sidewall 21*a* of the drawer body 21 and coupled to the front sidewall 21*a* of the drawer body 21 through the fitting portion 29. For example, a screw may pass through the boss type fitting portion 29. The screw may pass through the fitting portion 29 from the inner side of drawer body 21. Therefore, the drawer pane 23 may first be coupled to the drawer body 21 prior to the control panel 231. Then, the top cover 25 may be coupled to the drawer body 21. However, on the contrary, after the top cover 25 is first coupled to the drawer body 21, the drawer panel 23 may be coupled to the drawer body 21. In any case, before the control panel 231 is coupled to the top cover 25 or the drawer panel 23, connection of the connection pipe through the extension portion may be performed.

FIG. 17 illustrates another example of a laundry treating apparatus according to the present invention. The laundry treating apparatus provided in this embodiment is different from that provided in the embodiment of FIG. 1 in that the first treating apparatus A is arranged above the second treating apparatus B.

The second treating apparatus shown in FIG. 1 and the second treating apparatus B shown in FIG. 17 may be provided to have the same structure, and FIG. 17 illustrates that the second treating apparatus B is provided for washing of laundry as an example.

The second treating apparatus B may include a second cabinet 91 that can support the cabinet 1 of the first treating apparatus A, a second tub 92 provided inside the second cabinet, for storing water therein, and a second drum 94 rotatably provided inside the second tub. Two treating apparatuses may be provided in one cabinet. That is, the first treating apparatus A may be arranged on one cabinet, and the second treating apparatus B may be arranged below one cabinet.

A second cabinet inlet 911 opened or closed by a second door 913 is provided on a front surface of the second cabinet 91. The second tub 92 may be provided in a hollow cylindrical shape, and a second tub inlet 921 is provided on a front surface of the second tub 92. The second cabinet inlet 911 and the second tub inlet 921 may be connected with each other through a gasket 925 to prevent water leakage from occurring.

The second tub 92 may be fixed into the second cabinet 91 through a second tub support unit 923. The second tub 92 is supplied with water through a second water supply pipe 926, and the water stored in the second tub 92 is discharged to the outside of the second cabinet 91 through a second drainage unit 927. The second tub water supply pipe 926 is opened or closed by a second tub water supply pipe valve 929 controlled by a controller (not shown) of the second treating apparatus.

The second drum 94 may be provided in a hollow cylindrical shape, and may be provided with a second drum inlet 941 at the front, wherein the second drum inlet 941 is communicated with the second cabinet inlet 911 and the second tub inlet 921.

An inner space of the second drum 94 is communicated with an inner space of the second tub 92 through a second drum through hole 943. The second drum 94 is rotated by a second driving unit that may include a second stator 945, a second rotor 946, and a second rotary shaft 947 for connecting the second drum with the second rotor by passing through a rear surface of the second tub. The second rotary shaft 947 may be provided in parallel with a bottom of the second cabinet 91.

If the first treating apparatus A of the laundry treating apparatus according to one embodiment of the present invention is provided to support the bottom of the second treating apparatus B (FIG. 1), the first treating apparatus A may be provided as described with reference to FIGS. 1 to 17.

However, if the first treating apparatus A is provided to be mounted on the second treating apparatus B as shown in FIG. 17, the first treating apparatus A provided in this embodiment may include a cabinet 1, a tub 2 provided inside the cabinet, for storing water therein, a drum 6 rotatably provided inside the tub, for storing laundry therein, and a first detergent supply unit 7 and a second detergent supply unit 8 for supplying a detergent to the tub. That is, if the laundry treating apparatus is configured as shown in FIG. 17, a drawer 2 may be omitted in the first treating apparatus A.

However, in the embodiment of FIG. 17, a cabinet inlet 13 arranged above the door 45 and a cabinet door 15 for opening or closing the cabinet inlet should be provided on an upper surface of the cabinet 1. Moreover, the first detergent box holder 255 and the second detergent box holder 256 to which the detergent supply units 7 and 8 are fixed should be provided to pass through the upper surface of the cabinet 1. The first detergent box holder 255 and the second detergent box holder 256 may be provided to be opened or closed by a first fitting hole door (not shown) and a second fitting hole door 19, which are rotatably provided on the upper surface of the cabinet 1.

Meanwhile, if a sectional area of the first water supply pipe 31 is greater than that of the detergent water supply pipe 35 or energy required for operation of the first valve 311 is greater than that required for operation of the second valve 517, the first valve 311 and the second valve 517 are preferably controlled as follows. That is, if water is supplied to the first detergent supply unit 7, it is preferable that the controller first controls the second valve 517 to open the detergent water supply pipe 35 and then controls the first valve 311 to open the first water supply pipe 31. If the sectional area of the first water supply pipe 31 is greater than that of the detergent water supply pipe 35 or energy required for operation of the first valve is greater than that required for operation of the second valve, and if the first water supply pipe 31 is first opened, a problem may occur in that the second valve 517 fails to open the detergent water supply pipe 35 due to a water pressure even though a power is supplied to the second valve 517.

On the contrary, if it is intended to block water supply to the first detergent supply unit 7, it is preferable that the controller first closes the first water supply pipe 31 through the first valve 311 and then closes the detergent water supply pipe 35 through the second valve 517.

Meanwhile, in this embodiment, the first treating apparatus A may not be a drawer type. That is, the first treating apparatus A may be provided such that the tub or the drum may not be ejected from the cabinet. Therefore, the cabinet serves as a housing for receiving the tub and the drum therein. Therefore, the housing that may be ejected from the cabinet while receiving the tub and the drum may be omitted in this embodiment.

It will be apparent to those skilled in the art that the present invention may be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

What is claimed is:

1. A laundry treating apparatus comprising:

a housing;

a tub located in the housing and configured to receive washing water;

a drum located in the tub and configured to rotate, the drum being configured to receive laundry;

a top cover located vertically above the housing and configured to cover an upper portion of the tub and an upper portion of the drum;

a driving unit fixed to a bottom of the tub to rotate the drum;

a door rotatably coupled to the top cover to selectively communicate inside of the tub and outside of the tub;

a detergent box configured to receive detergent and communicate with the tub, the detergent box including a main detergent box located at a first side of the top cover and a secondary detergent box located at a second side of the top cover;

a distributor located at a rear portion of the top cover and configured to receive washing water from an external water supply source and to distribute washing water;

a detergent water supply pipe connected to the distributor, the detergent water supply pipe comprising a main detergent water supply pipe configured to supply washing water to the main detergent box and a secondary detergent water supply pipe configured to supply washing water to the secondary detergent box; and a tub water supply pipe connected to the distributor and configured to supply washing water to the tub, wherein the top cover comprises:

a distributor holder configured to receive the distributor, a detergent box holder that is located outside of the door at positions corresponding to a left side of the door and a right side of the door, the detergent box holder comprising a main detergent box holder located at a first side of the top cover and configured to receive the main detergent box, and a secondary detergent box holder located at a second side of the top cover and configured to receive the secondary detergent box, and a first pass through that allows the detergent water supply pipe to extend from the distributer to a lower portion of the top cover.

2. The laundry treating apparatus according to claim 1, further comprising a detergent water supply pipe holder located on a lower surface of the top cover and configured to support the detergent water supply pipe.

3. The laundry treating apparatus according to claim 1, wherein the top cover further comprises a second pass through that allows the tub water supply pipe to extend from the distributor to the lower portion of the top cover.

4. The laundry treating apparatus according to claim 3, wherein the first pass through and the second pass through are located at the rear portion of the top cover.

5. The laundry treating apparatus according to claim 4, wherein the top cover defines an opening configured to communicate with an inside of the drum, wherein the distributor holder, the first pass through, and the second pass through are located at a rear of the opening, and wherein the detergent box holder is located at a front portion of the opening.

6. The laundry treating apparatus according to claim 1, wherein the detergent box holder includes:

a holder opening configured to receive the detergent box, and a stepped portion recessed from a periphery of the holder opening toward the lower portion of the top cover.

7. The laundry treating apparatus according to claim 6, wherein the detergent box holder further includes a housing holder located on a lower surface of the top cover and configured to couple a housing of the detergent box to the lower surface of the top cover.

8. The laundry treating apparatus according to claim 6, wherein the stepped portion of the detergent box holder includes:

a mounting rib that is configured to seat a detergent cover of the detergent box; and an inlet rib that extends downwardly from the mounting rib and that defines a detergent inlet.

9. The laundry treating apparatus according to claim 8, wherein the detergent box holder further includes an inner rib that is spaced apart from the inlet rib, that is located on a lower surface of the top cover, and that surrounds the inlet rib, and wherein the inner rib is configured to contact an inner circumference of a housing of the detergent box.

10. The laundry treating apparatus according to claim 9, wherein the detergent box holder further includes a detergent box rim holder that is located outside of the inner rib on the lower surface of the top cover and that is configured to hold a rim of the detergent box.

11. The laundry treating apparatus according to claim 1, wherein the top cover further comprises a rear rib that protrudes upward from a rear surface of the top cover and that extends toward both sides of the top cover.

12. The laundry treating apparatus according to claim 1, wherein the top cover further comprises a front rib that extends upward from a front end portion of the top cover and that is configured to prevent leakage of detergent to a front side of the top cover.

13. The laundry treating apparatus according to claim 12, wherein the top cover further comprises a front mounting rib that horizontally extends from a front surface of the front rib and that is configured to couple to a front surface of the housing.

14. The laundry treating apparatus according to claim 13, wherein the front mounting rib defines a cutting portion that is a space configured to expose an inside of the housing therethrough based on the top cover being mounted on the housing.

15. The laundry treating apparatus according to claim 14, wherein the front mounting rib includes a vertical coupling portion configured to couple to a control panel, wherein the front rib includes a horizontal coupling portion configured to couple to the control panel, and wherein the control panel is located in front of the front rib vertically above the front mounting rib based on the control panel being coupled to the top cover.

16. The laundry treating apparatus according to claim 1, wherein the top cover includes a coupling rib that extends downward from a side of the top cover and that is configured to couple to the housing and to cover the upper portion of the housing.

17. A laundry treating apparatus comprising:

a housing;

a tub located inside the housing and configured to receive washing water;

a drum located inside the tube and configured to rotate, the drum being configured to receive laundry;

a driving unit fixed to a bottom of the tub to rotate the drum;

a top cover located vertically above the housing and configured to cover an upper portion of the tub and an upper portion of the drum;

a door rotatably coupled to the top cover to selectively communicate inside of the tub and outside of the tub;

a detergent box configured to receive detergent and communicate with the tub;

a connection pipe that connects the detergent box to a side portion of the tub;

a distributor located at a rear side of the top cover and configured to receive washing water from an external water supply source and to distribute washing water;

a detergent water supply pipe connected to the distributor and configured to supply washing water to the detergent box; and a tub water supply pipe connected to the distributor and configured to supply washing water to the tub, wherein the top cover comprises a detergent box holder located at a front side of the top cover and configured to support the detergent box, the detergent box holder being located outside of the door at positions corresponding to a left side of the door and a right side of the door, and wherein an entrance space is defined between a front surface of the housing and the top cover, and is configured to expose at least a portion of the detergent box or the connection pipe.

18. The laundry treating apparatus according to claim 17, wherein the entrance space is defined at one or more of a front portion of the top cover or the front surface of the housing.

19. The laundry treating apparatus according to claim 18, further comprising a front mounting rib that horizontally extends from the front portion of the top cover and that defines at least a portion of the entrance space.

20. The laundry treating apparatus according to claim 19, wherein a portion of the connection pipe is disposed inside of the entrance space.

21. The laundry treating apparatus according to claim 17, wherein at least a portion of the front surface of the housing is spaced apart from a front portion of the top cover, and wherein the entrance space is defined between the front surface of the housing and the front portion of the top cover.

22. The laundry treating apparatus according to claim 19, further comprising an extension portion that extends forward from the front surface of the housing, and wherein at least a portion of the extension portion is spaced apart from the front mounting rib, and wherein the entrance space is defined between at least the portion of the extension portion and the front mounting rib.

* * * * *